US010029844B2

(12) United States Patent
Seki et al.

(10) Patent No.: US 10,029,844 B2
(45) Date of Patent: Jul. 24, 2018

(54) AEROSOL HOUSING MECHANISM AND AEROSOL-TYPE PRODUCT HAVING THE AEROSOL HOUSING MECHANISM

(71) Applicants: MITANI VALVE CO., LTD., Chuo-ku, Tokyo (JP); DAIZO CORPORATION, Osaka-shi, Osaka (JP)

(72) Inventors: Masaaki Seki, Tokyo (JP); Masato Suzuki, Tokyo (JP); Ryoichi Owada, Kyoto (JP)

(73) Assignees: MITANI VALVE CO., LTD., Tokyo (JP); DAIZO CORPORATION, Osaka (JP)

( * ) Notice: Subject to any disclaimer, the term of this patent is extended or adjusted under 35 U.S.C. 154(b) by 112 days.

(21) Appl. No.: 15/039,660

(22) PCT Filed: Nov. 28, 2014

(86) PCT No.: PCT/JP2014/081568
§ 371 (c)(1),
(2) Date: May 26, 2016

(87) PCT Pub. No.: WO2015/083642
PCT Pub. Date: Jun. 11, 2015

(65) Prior Publication Data

US 2017/0166390 A1 Jun. 15, 2017

(30) Foreign Application Priority Data

Dec. 3, 2013 (JP) ..... 2013-250442
Apr. 30, 2014 (JP) ..... 2014-093537

(51) Int. Cl.
*B65D 83/00* (2006.01)
*B65D 83/38* (2006.01)
(Continued)

(52) U.S. Cl.
CPC ..... *B65D 83/38* (2013.01); *B65D 83/44* (2013.01); *B65D 83/62* (2013.01)

(58) Field of Classification Search
CPC ..... B65D 83/34; B65D 83/345; B65D 83/48; B65D 83/44; B65D 83/62
(Continued)

(56) References Cited

U.S. PATENT DOCUMENTS 2,789,012 A * 4/1957 Bretz, Jr. ..... B65D 83/20 239/573
2,867,356 A * 1/1959 Thomas ..... B65D 83/34 222/148
(Continued)

FOREIGN PATENT DOCUMENTS

JP S62-3476 U 1/1987
JP H08103700 A 4/1996
(Continued)

OTHER PUBLICATIONS

International Search Report dated Mar. 17, 2015 for PCT/JP2015/050735 and English translation.

*Primary Examiner* — Paul R Durand
*Assistant Examiner* — Randall Gruby
(74) *Attorney, Agent, or Firm* — Lucas & Mercanti, LLP

(57) ABSTRACT

An expanded housing (2) including an outer tubular portion (2*a*), a center-top tubular portion (2*b*), an annular ceiling portion (2*c*), and a center-bottom tubular portion (2*d*) is an integrally molded plastic product. Vertical plate rib-shaped portions (2*h*) for increasing strength are similarly integrally molded between the outer tubular portion (2*a*) and the center-top tubular portion (2*b*). An inner passage region (B) for upward passage of content is set in the center tubular portion (2*b*). A housing cover (28) provided in such a form as to surround the lower side of the expanded housing (2) forms an outer passage region (A) which is disposed
(Continued)

between the housing cover (28) and an outer peripheral surface of the expanded housing (2) so as to extend downward from an upper-end-side inner space region of an inner bag-shaped container (1*g*) to the inner passage region (B). A cone-shaped piece (28*k*) enters into an individual upper-end-side inner space region set between adjacent vertical plate rib-shaped portions (2*h*) and acts as an entrance portion of the outer passage region (A). Thus, residual air between vertical plate rib-shaped portions is reliably discharged.

9 Claims, 12 Drawing Sheets

(51) Int. Cl.
*B65D 83/44* (2006.01)
*B65D 83/62* (2006.01)

(58) Field of Classification Search
USPC ..... 222/402.1–402.25
See application file for complete search history.

(56) References Cited

U.S. PATENT DOCUMENTS 3,704,813 A * 12/1972 Devol ..... F16K 1/305 137/315.18
3,733,009 A * 5/1973 Rouzier ..... B65D 83/34 222/148
4,405,064 A * 9/1983 Stoody ..... B65D 83/62 222/136
4,532,690 A * 8/1985 Del Bon ..... B65D 83/14 222/402.25
4,991,751 A * 2/1991 Naku ..... B65D 83/205 222/402.13
5,018,552 A * 5/1991 Politi ..... B65D 47/02 137/614.11
5,027,985 A * 7/1991 Abplanalp ..... B65D 83/48 222/402.1
5,158,215 A * 10/1992 Comment ..... B65D 83/44 222/396
5,305,925 A * 4/1994 Vogel ..... B65D 83/75 141/20
5,337,929 A * 8/1994 van der Heijden ..... B23P 15/16 222/402.18
5,350,088 A * 9/1994 Smith ..... B65D 83/36 222/402.1
5,593,069 A * 1/1997 Jinks ..... B65D 83/54 222/246
5,622,282 A * 4/1997 Yazawa ..... B65D 83/38 222/105
5,695,096 A * 12/1997 Yquel ..... B65D 83/34 222/148
5,803,319 A * 9/1998 Smith ..... B05B 11/0059 222/402.19
6,098,846 A * 8/2000 Yazawa ..... B65D 83/62 222/402.24
7,278,556 B2 * 10/2007 Goujon ..... B65D 83/54 222/402.1
7,341,169 B2 * 3/2008 Bayer ..... B65D 83/34 222/145.2
8,602,272 B2 * 12/2013 Burel ..... B65D 83/54 222/246
9,038,858 B2 * 5/2015 Hanai ..... B65D 83/62 222/135
2007/0272767 A1 * 11/2007 Niggemann ..... B65D 83/20 239/337
2009/0008584 A1 * 1/2009 Fontela ..... B65D 83/38 251/118
2010/0044400 A1 * 2/2010 Laidler ..... B65D 83/44 222/402.1
2014/0042190 A1 * 2/2014 Martin ..... B65D 83/546 222/402.16
2015/0197392 A1 * 7/2015 Franz ..... B65D 83/48 222/402.1
2018/0002080 A1 * 1/2018 Doerflinger ..... B65D 49/08

FOREIGN PATENT DOCUMENTS

JP H08169482 A 7/1996
JP 2000062870 A 2/2000
JP 2000281159 A 10/2000
JP 2006321532 A 11/2006
JP 2009521374 A 6/2009
JP 2011136747 A 7/2011
JP 2012111549 A 6/2012

* cited by examiner

AEROSOL HOUSING MECHANISM AND AEROSOL-TYPE PRODUCT HAVING THE AEROSOL HOUSING MECHANISM

CROSS REFERENCE TO RELATED APPLICATION

This Application is a 371 of PCT/JP2014/081568 filed on Nov. 28, 2014, which, in turn, claimed the priority of Japanese Patent Application No. JP2013-250442 filed on Dec. 3, 2013 and JP2014-093537 filed on Apr. 30, 2014, all applications are incorporated herein by reference.

TECHNICAL FIELD

The present invention relates to a plastic aerosol housing mechanism which is arranged close to an upper-end opening side of an aerosol container that stores emission target content and ejection gas and is provided with a housing portion that stores a stem and a stem gasket performing an operation of sealing and ejecting the content and the entirety of which is integrally molded.

In particular, the present invention relates to an aerosol housing mechanism which is a plastic product obtained by integrally molding two parts including a mounting cup attached to an opening side of a conventional aerosol container body and a housing held by the mounting cup so as to store a lower portion of the stem.

In the present specification, a structure obtained by integrally molding the entirety of the mounting cup and the housing will be referred to as an "expanded housing" as necessary.

The present invention relates to a technique of decreasing the amount of synthetic resins used for molding the expanded housing and securing the strength of an aerosol housing mechanism formed of the expanded housing.

In the present specification, a side close to an opening side of an aerosol container (an outer container plus an inner container and an outer container plus an inner bag-shaped container) will be referred to an "upper side", and a side close to a bottom surface side opposite the opening side in a longitudinal direction will be referred to a "lower side". A side orthogonal to the up-down vertical direction is referred to as a "horizontal side".

BACKGROUND ART

An aerosol housing mechanism which uses the expanded housing is already proposed (see Patent Documents 1 and 2).

The proposed expanded housing has an advantage that it is possible to eliminate the time and labor required for a process step of creating a mounting cup and a housing individually and integrating both and to prevent deformation and damage of the housing during integration.

On the other hand, there is a room for improvement in that the strength as an aerosol housing mechanism is maintained while decreasing the amount of the synthetic resin required for molding the expanded housing as much as possible.

The present applicant has proposed a bag-shaped container structure in which air generated in an upper-end-side space region of an inner bag-shaped container of a dual-structure aerosol container is discharged by deformation of an upper-end-side neck portion of the inner bag-shaped container in a valve unit loading step after raw liquid is ejected (see Patent Document 3).

The inner bag-shaped container of which the upper-end-side neck portion is configured to be deformable has an advantage that the air generated in the upper space region can be discharged to an outside of the container.

On the other hand, there is a room for improvement in that it is necessary to set the shape of the upper-end-side neck portion of the inner bag-shaped container to a specific deformable shape.

CITATION LIST

Patent Document

Patent Document 1: Japanese Utility Model Application Laid-Open No. S62-3476

Patent Document 2: Japanese Patent Application Laid-Open No. H8-169482

Patent Document 3: Japanese Patent Application Laid-Open No. 2011-136747

SUMMARY OF THE INVENTION

Problems to be Solved by the Invention

The present invention uses the following configuration aspects to cope with the above-described rooms for improvement.

(11) Rib-shaped portions for reinforcement are integrally molded between an outer tubular portion and a central tubular portion that form an expanded housing.

(12) The rib-shaped portions are formed in a radial direction of the outer tubular portion and the central tubular portion.

(13) A vertical concave portion is formed in an inner peripheral surface, close to an outer peripheral surface, of the central tubular portion in which a vertical groove-shaped portion for passage of content is not formed to decrease the thickness of the central tubular portion itself.

(14) Shorter rib-shaped portions are selectively formed between the inner peripheral surface of the outer tubular portion and the rear-side outer peripheral surface portion (=the portion in which the vertical concave portion is not formed and which is located closer to the inner peripheral surface of the outer tubular portion than the vertical concave portion) of the vertical groove-shaped portion of the inner peripheral surface of the central tubular portion (that is, the shorter rib-shaped portions are selectively formed between the inner peripheral surface of the outer tubular portion and the outer peripheral surface of the central tubular portion).

(15) A dual-sealing plastic intermediate cover body arranged on the upper surface of the stem gasket is held on an annular ceiling portion between the outer tubular portion and the central tubular portion.

(16) The outer peripheral surface of the outer tubular portion is protected by a three-layer member including the upper-end-side annular portions of the outer container, the inner container, and the inner bag-shaped container, and an outer annular skirt portion of the cover cap in relation to the annular ceiling portion of the expanded housing or the like.

(17) A slit-shaped portion for entrance of content is additionally provided in a circumferential portion of the central tubular portion of the housing of the dual-structure aerosol container (that is, the slit-shaped portion is provided separately from the vertical hole portion formed in the bottom portion of the conventional center-top tubular portion).

(18) A bypass route for discharging content from an upper end side of the housing into the inside of the housing is provided on an outer peripheral surface side of the housing by setting the housing cover body without changing the shape of the inner bag-shaped container of the dual-structure aerosol container particularly so that residual air on the upper end side is discharged during an initial emission operation.

An object of the present invention including such configuration aspects is to reduce the amount of synthetic resins used for molding the expanded housing while preventing deformation or damage of the expanded housing.

Another object of the present invention is to prevent content from entering and penetrating from a stem gasket to make contact with a metal cover by providing an annular plastic cover in an upper surface portion of a stem gasket.

Another object of the present invention is to allow residual content in an upper space region of an inner bag-shaped container to reliably flow into the housing even when the inner bag-shaped container makes contact with a lower side of a central tubular portion due to a decrease in the amount of content by providing a slit-shaped portion for inside/outside communication in a circumferential portion of the central tubular portion of the housing.

Another object of the present invention is to set an entrance portion (inlet portion) of an outer passage region between a plurality of reinforcement vertical plate rib-shaped portions formed in a radial direction on the lower surface of a flange-shaped portion (annular ceiling portion) between the inner and outer tubular portions of the expanded housing to allow residual air between the vertical plate rib-shaped portions to be reliably discharged.

Another object of the present invention is to provide various techniques for discharging residual air in an inner space region on the upper end side of the inner bag-shaped container in an emission mechanism of a dual-structure aerosol container by setting a new content discharge bypass route formed of the outer passage region of the expanded housing which uses a housing cover.

Another object of the present invention is to realize effective use of an expanded housing and reduction of a product cost in an emission mechanism of a dual-structure aerosol container by the residual air discharging process which uses an expanded housing having a conventional shape, to which a dip tube for entrance of content can be attached.

Another object of the present invention is to eliminate the use of metal in an entire range of regions which make contact with emission target content by using a coil spring (for biasing a stem arranged in the central tubular portion), an inner container, an inner bag-shaped container, and a dual-sealing intermediate cover body which are formed of plastics.

Solutions to Problems

The present invention solves the aforementioned problems using aerosol housing mechanisms having the following configuration aspects.

(1) An aerosol housing mechanism including:

an outer tubular portion (for example, an outer tubular portion 2*a* or 10*a* described later) attached to an opening side (for example, an upper-end annular portion 1*b* described later) of a container body (for example, an aerosol container 1 described later) that stores emission target content and ejection gas;

a central tubular portion (for example, a center-top tubular portion 2*b* or 10*b* or a center-bottom tubular portion 2*d* or 10*d* described later) formed on an inner side of the outer tubular portion so as to store at least a lower-side portion of a stem (for example, a stem 3 described later) that operates with a content emission operation in an interlocked manner;

an annular ceiling portion (for example, an annular ceiling portion 2*c* or 10*c* described later) formed between an upper end portion of the outer tubular portion and an upper end portion of the central tubular portion; and a rib-shaped portion (for example, a vertical plate rib-shaped portion 2*h* or 10*h* described later) formed between the outer tubular portion and the central tubular portion to enhance a structural strength, wherein entireties of the outer tubular portion, the central tubular portion, the annular ceiling portion, and the rib-shaped portion are integrally molded using a synthetic resin.

(2) The aerosol housing mechanism according to (1), wherein a plurality of the rib-shaped portions is formed in a radial form to extend from the central tubular portion to the outer tubular portion.

(3) The aerosol housing mechanism according to (1) or (2), wherein a vertical groove-shaped portion (for example, a vertical groove-shaped portion 2*f* or 10*f* described later) for passage of content is formed in a portion of an inner peripheral surface of the central tubular portion, and a vertical concave portion (for example, a vertical concave portion 2*g* or 10*g* described later) is formed in a portion of an outer peripheral surface of the central tubular portion, which is on a rear side of an inner peripheral surface portion in which the vertical groove-shaped portion is not formed.

(4) The aerosol housing mechanism according to (3), wherein the rib-shaped portion is formed between the inner peripheral surface of the outer tubular portion and a rear-side outer peripheral surface portion of the vertical groove-shaped portion.

(5) The aerosol housing mechanism according to any one of (1) to (4), wherein the annular ceiling portion includes:

an annular lower end portion (for example, a lower-inner-side step 2*k* or 10*k* described later) formed on an inner end side so as to hold an outer peripheral edge portion of a stem gasket (for example, a stem gasket 5 described later) that performs a valve action between the stem and the stem gasket; and an annular upper end portion (for example, an upper-outer-side step 2*m* or 10*m* described later) formed on an upper side of the lower end portion so as to hold an outer peripheral edge portion of an annular plastic cover body (for example, an intermediate cover body 7 described later) provided in an upper surface portion of the stem gasket.

(6) The aerosol housing mechanism according to any one of (1) to (5), wherein an outer peripheral surface of the outer tubular portion is protected by a three-layer member including:

a tubular skirt portion (for example, an annular skirt portion 8*b* described later) on an outer end side of an annular metal cover body (for example, a cover cap 8 described later) that covers the annular ceiling portion;

an upper-end intermediate annular portion (for example, an upper-end annular portion 1*b* described later) which is a portion of an outer container (for example, an outer container 1*a* described later) and is arranged on an inner side of the tubular skirt portion; and an upper-end inner annular portion (for example, an upper-end inner annular portion 1*e* or 1*h* described later) which is a portion of an inner container (for example, an inner container 1*d* or an inner bag-shaped container 1*g* described later) provided in an inner space region of the outer container and is arranged on an inner side of the upper-end intermediate annular portion.

(7) The aerosol housing mechanism according to any one of (1) to (6), wherein the central tubular portion includes a lower tubular portion (for example, a center-bottom tubular portion 2*d* or 10*d* described later) to which a tube for entrance of content is attached.

(8) The aerosol housing mechanism according to any one of (1) to (7), further including:

a housing cover (for example, housing covers 25 to 29 described later) of an upper opening, provided in such a form as to surround a lower side of the central tubular portion to form an outer passage region between the housing cover and the outer peripheral surface of the central tubular portion, the outer passage region extending downward from an upper end side of an inner space region of the container body to an inner passage region inside the central tubular portion, wherein the emission target content ejected to an outside of the container moves downward from the upper end side along the outer passage region and then flows upward along the inner passage region.

(9) The aerosol housing mechanism according to any one of (1) to (8), wherein the housing cover (for example, a housing cover 27, 28, or 29: FIGS. 8 to 12, described later) includes an upper-end-side piece (for example, a radial stair-shaped piece 27*g* or a cone-shaped piece 28*k* or 29*k* described later) which enters into an individual upper-end-side inner space region set between the adjacent rib-shaped portions and acts as an entrance portion of the outer passage region.

The aerosol housing mechanism having such a configuration and an aerosol-type product including the aerosol housing mechanism and storing various emission target contents and various ejection gases described later are the subjects of the present invention.

Effects of the Invention

The present invention provides the following effects due to the above-described solving means.

(21) It is possible to reduce the amount of synthetic resins used for molding the expanded housing while preventing deformation or damage of the expanded housing.

(22) It is possible to prevent content from entering and penetrating from a stem gasket to make contact with a metal cover by providing an annular plastic cover in an upper surface portion of a stem gasket.

(23) It is possible to eliminate the use of metal in an entire range of regions which make contact with emission target content.

(24) It is possible to allow residual content in an upper space region of an inner bag-shaped container to reliably flow into the housing even when the inner bag-shaped container makes contact with a lower side of a central tubular portion due to a decrease in the amount of content.

(25) It is possible to allow residual air between reinforcement vertical plate rib-shaped portions of a flange-shaped portion (annular ceiling portion) of an expanded housing to be reliably discharged.

(26) It is possible to realize effective use of an expanded housing and reduction of a product cost in an emission mechanism of a dual-structure aerosol container, discharging the residual air.

(27) It is possible to provide various techniques for discharging residual air in an inner space region on the upper end side of the inner bag-shaped container in an emission mechanism of a dual-structure aerosol container.

MODE FOR CARRYING OUT THE INVENTION

Figure 1:
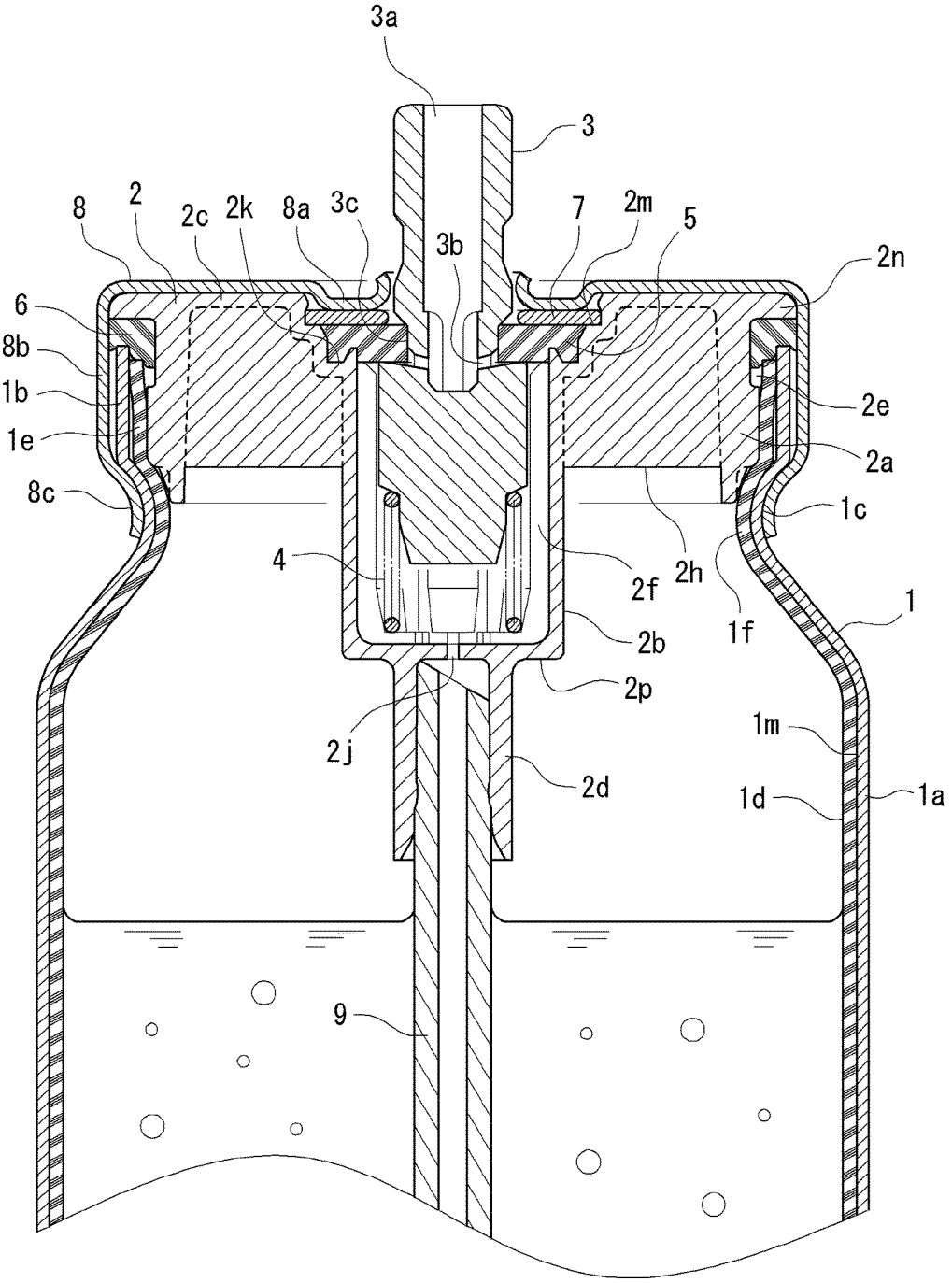
FIG. 1 is an explanatory diagram illustrating an aerosol-type product to which a housing mechanism formed of an expanded housing 2 is attached.

The mode for carrying out the present invention will be described with reference to FIGS. 1 to 12. Here, an aerosol housing mechanism of the present invention is roughly classified into a mechanism without a housing cover (FIGS. 1 to 5) and a mechanism with the housing cover (FIGS. 6 to 12).

In principle, in the following description, a component (for example, an outer container 1*a*) indicated by a reference numeral including an alphabet indicates that the component is a part of a component (for example, an aerosol container 1) indicated by the number in the reference numeral.

In the aerosol housing mechanism illustrated in FIGS. 1 to 12,

1 is a conventional aerosol container in which emission target content and ejection gas are stored (filled),

1*a* is a hard outer container which is an upper opening,

1*b* is an upper-end annular portion which is on an upper end side of the outer container 1*a* and in which an expanded housing 2, 10, or the like described later is arranged,

1*c* is an annular concave portion of the outer container 1*a* which is initially formed in a continuous portion at the lower end of the upper-end annular portion 1*b* so as to plastically deform a lower end of an annular skirt portion 8*b* of a cover cap 8 (described later) toward the inner side according to conventional crimping processing to fix the lower end in a state in which the cover cap 8 is set on the upper-end annular portion 1*b*,

1*d* is a soft inner container (see FIG. 1) which is arranged on an inner side of the outer container 1*a* so as to store emission target content (raw liquid) and ejection gas in an inner space region thereof, for example, and which is an upper opening,

1*e* is an upper-end inner annular portion which is on the upper end side of the inner container 1*d* and is arranged and held between the upper-end annular portion 1*b* of the outer container 1*a* and an outer tubular portion 2*a* or 10*a* (described later),

1*f* is an inner annular concave portion of the inner container 1*d*, which is formed during blow-molding and is arranged on the inner side of the annular concave portion 1*c* of the outer container 1*a*,

1*g* is a soft inner bag-shaped container (see FIGS. 2, 5 to 8, and 10) which is an upper opening and serves as an inner container which is arranged on the inner side of the outer container 1*a* so as to store ejection gas between the container inner surface 1*a* on the outer side thereof and the inner bag-shaped container and stores emission target content (raw liquid) in the inner space region thereof,

1*h* is an upper-end inner annular portion (an upper-end-side inner peripheral surface of the inner bag-shaped container) which is on the upper end side of the inner bag-shaped container 1*g* and is arranged and held between the upper-end annular portion 1*b* of the outer container 1*a* and an outer tubular portion 2*a* or 10*a* (described later),

1*j* is an inner annular concave portion (an upper-end-side inner peripheral surface of the inner bag-shaped container) of the inner bag-shaped container 1*g*, which is arranged in an opposing portion on the inner side of the annular concave portion 1*c* of the outer container 1*a* and is formed on the lower end side of the upper-end inner annular portion 1*h* during blow-molding of the inner bag-shaped container,

1*k* is a bellows-shaped portion which has a function of expanding and contracting in a vertical direction and is formed on the upper side of the inner bag-shaped container 1*g* and in which ejection gas can be filled in an inner space region provided continuously from a space between the upper end of the upper-end annular portion 1*b* and the upper-end inner annular portion 1*h* in a naturally expanded state before a housing mechanism (described later) to which the inner bag-shaped container having content stored therein is attached is fixed to the aerosol container 1 and in which the inner annular concave portion 1*j* of the inner bag-shaped container contracts to a portion corresponding to a crimping processing position of the cover cap as illustrated in FIGS. 2, 5 to 8, and 10 according to pressing of the cover cap 8 immediately after the ejection gas is filled,

1*m* is a container inner surface close to the inner space region of the outer container 1*a*, and

1*n* is a pressure application space region which is defined by an annular circumferential portion and a bottom portion between the outer container 1*a* and the inner bag-shaped container 1*g* and in which ejection gas is filled.

Moreover,

2*a* or 10 is an expanded housing with which the function of a conventional mounting cup is combined, and the entirety of which is integrally molded using a plastic material, and which is arranged in the upper-end annular portion 1*b* (opening portion) of the outer container 1*a* and in which a conventional valve mechanism such as a stem 3, a coil spring 4, and a stem gasket 5 (which will be described later) is stored and held in a central tubular portion,

2*a* or 10*a* is an outer tubular portion in which the upper-end inner annular portions 1*e* and 1*h* of the inner container 1*d* and the inner bag-shaped container 1*g*, the upper-end annular portion 1*b* of the outer container 1*a*, and an annular skirt portion 8*b* of the cover cap 8 (described later) are arranged in a so-called three-layer state in an outer peripheral surface in that order toward the outer side,

2*b* or 10*b* is a large-diameter center-top tubular portion which has the same vertical central axis as the outer tubular portion 2*a* or 10*a* and stores and holds the lower portion of the stem 3 (described later) and the coil spring 4,

2*c* or 10*c* is an annular ceiling portion that serves as a so-called ceiling portion between the outer tubular portion 2*a* or 10*a* and the center-top tubular portion 2*b* or 10*b*,

2*d* or 10*d* is a small-diameter center-bottom tubular portion which is continuously formed downward from the center-top tubular portion 2*b* or 10*b* so as to attach a pipe 9 (described later),

2*e* or 10*e* is an outer annular concave portion which is formed in an upper-end-side outer peripheral surface of the outer tubular portion 2*a* or 10*a* so as to hold an inner peripheral surface of a housing gasket 6 (described later),

2*f* or 10*f* is six vertical groove-shaped portions in total for passages of content, formed at equal intervals in the inner peripheral surface of the center-top tubular portion 2*b* or 10*b*,

2*g* or 10*g* is six vertical concave portions in total for reducing the amount of molding resins, formed at equal intervals on a rear side of the inner peripheral surface in which the vertical groove-shaped portion 2*f* or 10*f* is not formed, which is on the outer peripheral surface of the center-top tubular portion 2*b* or 10*b*,

2*h* or 10*h* is six vertical plate rib-shaped portions in total for reinforcement, formed at equal intervals in a vertical plate form, continuous to the annular ceiling portion 2*c* or 10*c*, in a radial direction of the outer tubular portion and the center-top tubular portion between the inner peripheral surface of the outer tubular portion 2*a* or 10*a* and the rear-side portion (the portion in which the vertical concave portion 2*g* or 10*g* is not formed) of the vertical groove-shaped portion 2*f* or 10*f* on the outer peripheral surface of the center-top tubular portion 2*b* or 10*b*,

2*j* or 10*j* is a vertical hole portion for passage of content, formed in a boundary portion between the center-top tubular portion 2*b* or 10*b* and the center-bottom tubular portion 2*d* or 10*d*,

2*k* or 10*k* is an annular lower-inner-side step formed in an innermost portion of the annular ceiling portion 2*c* or 10*c* so as to hold a stem gasket 5 (described later),

2*m* or 10*m* is an annular upper-outer-side step formed immediate above an outer portion of the lower-inner-side step 2*k* or 10*k* so as to hold an intermediate cover body 7 (described later),

2*n* or 10*n* is an annular flange-shaped portion which is a portion that protrudes outward from the outer tubular portion 2*a* or 10*a* on the outer end side of the annular ceiling portion 2*c* or 10*c* so as to hold the upper end surface of the housing gasket 6, (described later),

2*p* is an annular downward step continuously formed between the upper end portion of the center-bottom tubular portion 2*d* and the lower end portion of the center-top tubular portion 2*b*,

10*p* is a vertical slit-shaped portion (see FIG. 5) which is formed in the vertical concave portion 10*g* (and a vertical portion of the inner peripheral surface in which the vertical groove-shaped portion 10*f* is not formed) of the center-top tubular portion 10*b* and serves as an opening for pas sage of content between the inside and the outside of the center-top tubular portion,

11 is a tubular flow-rate adjustment member (see FIG. 5) which is a member in which a vertical convex portion inserted from bottom to the vertical concave portion 10*g* on the outer peripheral surface of the center-top tubular portion 10*b* and vertical concave portions on both sides of the convex portion, corresponding to a rear-side outer peripheral surface of the portion in which the vertical groove-shaped portion 10*f* is not formed are alternately formed on an inner peripheral surface thereof and which blocks the lower-side portion of the vertical slit-shaped portion 10*p* in a state of being attached to the vertical concave portion and the like to adjust the actual area of the opening for passage of content, of the vertical slit-shaped portion, and

11*a* is an annular step (see FIG. 5) formed on a lower-side portion of the inner peripheral surface of the flow-rate adjustment member 11 so as to engage with the annular lower surface of the center-top tubular portion 10*b*.

Moreover,

3 is a conventional stem attached to an operation button (not illustrated) so as to operate in a vertical direction in an interlocked manner to perform a valve action between the stem and the stem gasket 5 (described later),

3*a* is an inner space region of the stem and is an inner passage region for passage of emission target content (raw liquid) and ejection gas,

3*b* is a pair of stem hole portions (valve action portions) that allows the inner passage region 3*a* and the inner space region of the center-top tubular portion 2*b* or 10*b* to communicate with each other in an operation mode, and

3*c* is an inner annular concave portion formed in a circumferential direction of an outer peripheral surface of the stem having such a form that includes the stem hole portion 3*b* to perform a valve action between the stem and the stem gasket 5 (described later).

Moreover,

4 is a conventional coil spring arranged between the bottom surface portion of the center-top tubular portion 2*b* or 10*b* and the stem 3 so as to bias the stem in an upward direction,

5 is an annular stem gasket (valve action portion) held in the lower-inner-side step 2*k* or 10*k* of the expanded housing 2 or 10 and the inner annular concave portion 3*c* of the stem 3 so as to perform a valve action on the stem hole portion 3*b* and a seal action on the inner space region of the center-top tubular portion 2*b* or 10*b*,

6 is an annular housing gasket disposed closely to the upper-end annular portions of the outer container 1*a*, the inner container 1*d*, and the inner bag-shaped container 1*g* and the outer annular concave portion 2*e* or 10*e* and the annular flange-shaped portion 2*n* or 10*n* of the expanded housing 2 or 10 to perform a seal action, and

7 is an annular intermediate cover body held in the upper-outer-side step 2*m* or 10*m* of the expanded housing 2 or 10 in a form that covers the upper surface portion excluding the inner end side of the stem gasket 5 to perform a so-called dual-seal action on a seal leakage between the stem gasket and the expanded housing 2 or 10 (the lower-inner-side step 2*k* or 10*k*).

Moreover, the expanded housing 2 may be inserted in the cover cap 8 without scattering when the expanded housing 2 is attached to the aerosol container 1, and an upper outer circumference of the cover cap may be deformed toward the inner side in a radial direction so as to engage with the lower end of the annular flange-shaped portion 2*n*.

Moreover,

8 is an aluminum cover cap, for example, which includes a top surface having a central opening for passage of the stem and a side surface thereof and which presses and holds the intermediate cover body 7, deforms the lower end side of the upper-end annular portion 1*b* and the upper-end inner annular portion 1*e* or 1*h* of the outer container 1*a* and the inner container 1*d* (or the inner bag-shaped container 1*g*) toward the inner side by crimping processing in a state in which the housing gasket 6 and the like are incorporated therein, and tightly integrates the aerosol container and the expanded housing 2 or 10,

8*a* is an upper annular concave portion set on the inner end side of the upper surface of the cover cap to press and hold the intermediate cover body 7,

8*b* is an annular skirt portion formed on the outer end side of the top surface of the cover cap,

8*c* is an outer annular concave portion formed on the lower end side of the annular skirt portion 8*b* by the crimping processing, and

9 is a pipe (see FIG. 1) for entrance of content, attached to the center-bottom tubular portion 2*d* or 10*d* of the expanded housing 2 or 10 of an aerosol-type product of such a type that uses the inner container 1*d*.

Here, the inner container 1*d*, the inner bag-shaped container 1*g*, the expanded housing 2 and 10, the stem 3, the intermediate cover body 7, the pipe 9, the flow-rate adjustment member 11, and the like are formed of plastics such as polypropylene, polyethylene, polyacetal, nylon, or polybutylene terephthalate.

Moreover, the outer container 1*a* is formed of aluminum or tin, the coil spring 4 is formed of stainless steel, the cover cap 8 is formed of metal such as aluminum, and stem gasket 5 and housing gasket 6 are made of plastic or rubber.

A plastic coil spring or a plastic plate spring may be used instead of the metal coil spring 4. When the plastic coil spring or the like is used, it is possible to eliminate the use of metal.

The followings are basic common features of the aerosol housing mechanism illustrated in FIGS. 1 to 12.

(31) The entireties of the outer tubular portion 2*a* or 10*a*, the center-top tubular portion 2*b* or 10*b*, the annular ceiling portion 2*c* or 10*c*, and the center-bottom tubular portion 2*d* or 10*d* which form the expanded housing 2 or 10 are integrally molded plastic products.

(32) The vertical plate rib-shaped portion 2*h* or 10*h* for reinforcement is similarly integrally molded between the outer tubular portion 2*a* or 10*a* and the center-top tubular portion 2*b* or 10*b*.

(33) The formation direction of the vertical plate rib-shaped portion 2*h* or 10*h* is the radial direction of the outer tubular portion 2*a* or 10*a* and the center-top tubular portion 2*b* or 10*b*.

(34) The vertical concave portion 2*g* or 10*g* is formed on the outer peripheral surface side of the portion of the center-top tubular portion 2*b* or 10*b*, in which the vertical groove-shaped portion 2*f* or 10*f* is not formed to decrease the thickness of the center-top tubular portion itself.

(35) The vertical plate rib-shaped portion 2*h* or 10*h* is formed between the inner peripheral surface of the outer tubular portion 2*a* or 10*a* and the rear-side outer peripheral surface portion (the portion in which the vertical concave portion 2*g* or 10*g* is not formed and which is disposed closer to the inner peripheral surface of the outer tubular portion than the vertical concave portion) of the vertical groove-shaped portion 2*f* or 10*f* of the center-top tubular portion 2*b* or 10*b*.

(36) The dual-sealing intermediate cover body 7 formed of plastics, arranged on the upper surface of the stem gasket 5 is held by the upper-outer-side step 2*m* or 10*m* formed close to the center-top tubular portion of the annular ceiling portion 2*c* or 10*c*.

(37) The outer peripheral surface of the outer tubular portion 2*a* or 10*a* is protected by the three-layer member including the upper-end inner annular portion 1*e* or 1*h*, the upper-end annular portion 1*b*, and the annular skirt portion 8*b*.

Figure 3:
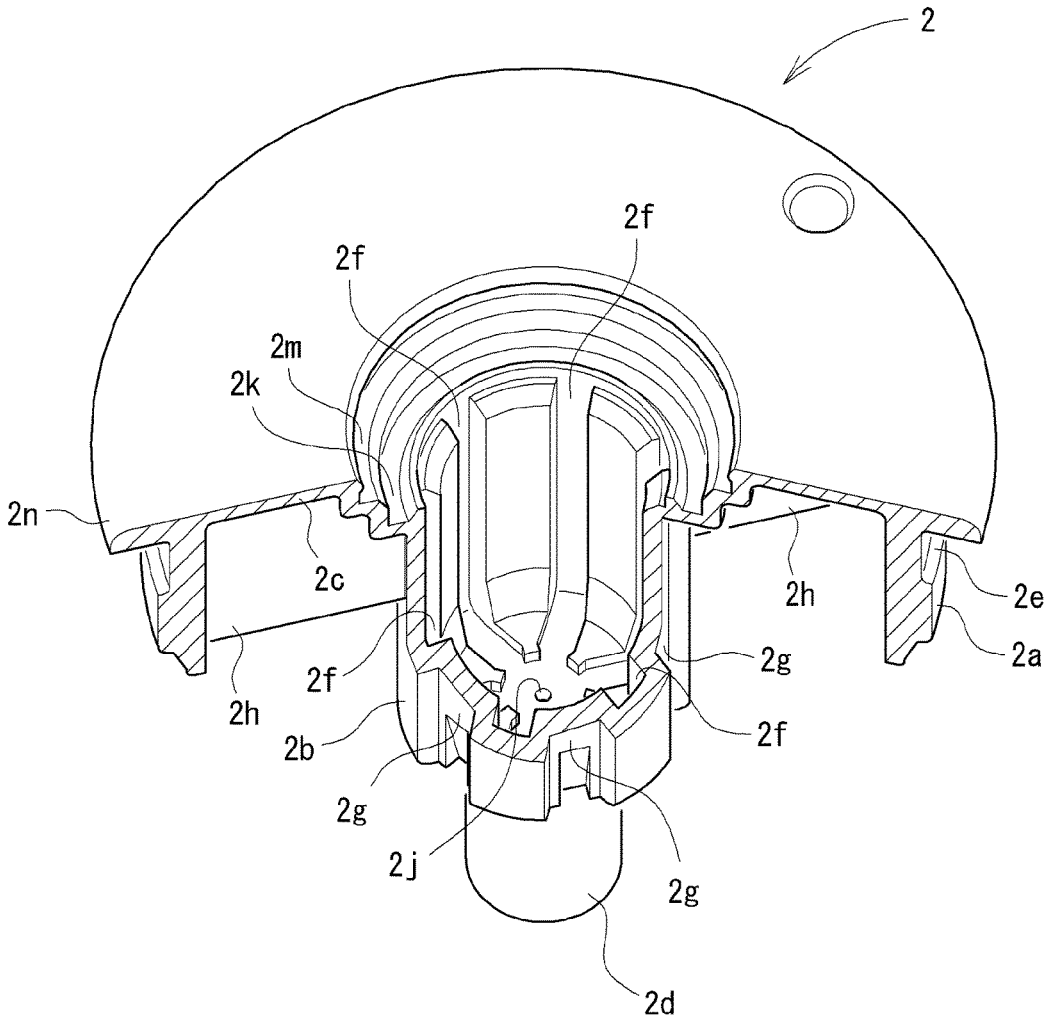
FIG. 3 is an explanatory diagram illustrating a perspective view state when the expanded housing 2 illustrated in FIGS. 1 and 2 is seen from an upper side.
Figure 4:
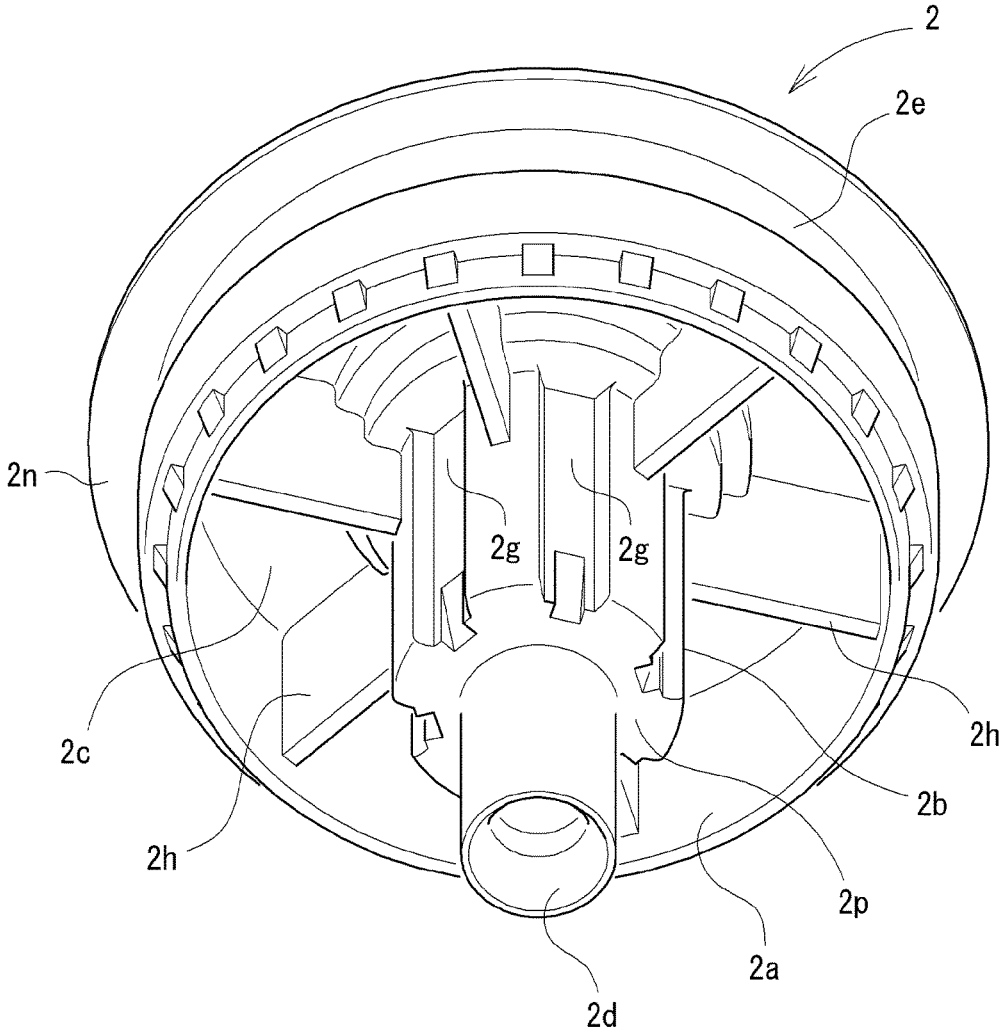
FIG. 4 is an explanatory diagram illustrating a perspective view state when the expanded housing 2 illustrated in FIGS. 1 and 2 is seen from a lower side.
Figure 5:
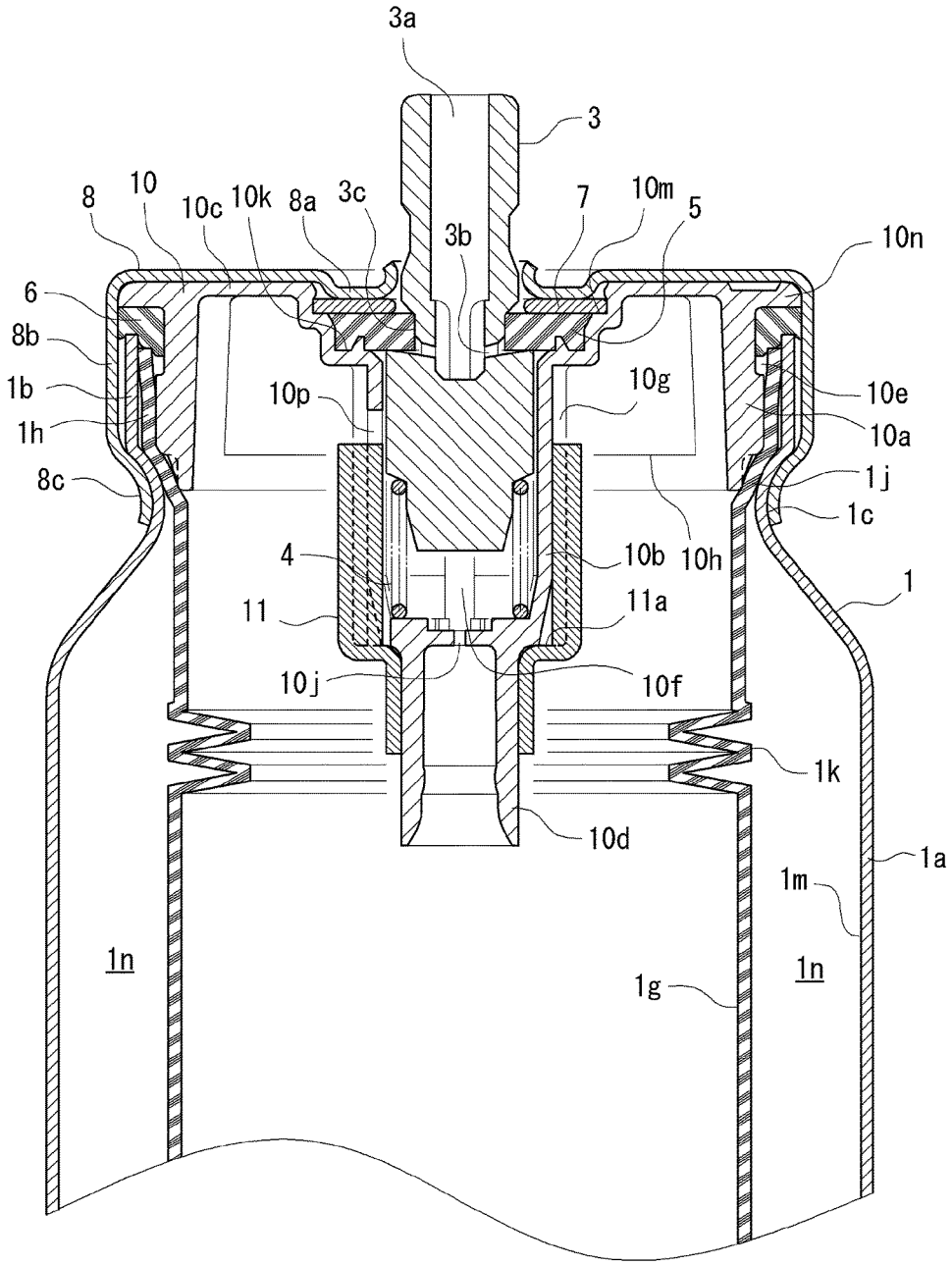
FIG. 5 is an explanatory diagram illustrating a state in which a flow-rate adjustment member 11 for setting an inlet opening area of a slit-shaped portion is attached to a central tubular portion of an expanded housing 10 in which a vertical slit-shaped portion 10*p* for entrance of content is formed in a circumferential portion of a center-top tubular portion of the expanded housing 2 illustrated in FIG. 2.

The following is a new feature of the aerosol housing mechanism illustrated in FIG. 5, which is a mechanism without the housing cover illustrated in FIGS. 1 to 5.

(38) The vertical slit-shaped portion 10*p* for inside/outside communication is formed in the circumferential portion of the center-top tubular portion 10*b* of the dual-structure aerosol container having the inner bag-shaped container 1*g*, and the flow-rate adjustment member 11 for adjusting the actual inside/outside communication area of the vertical slit-shaped portion is arranged.

As in (31), (32), and (33), the entire expanded housing is integrally molded in such an aspect that the vertical plate rib-shaped portions 2*h* or 10*h* are arranged between the outer tubular portion 2*a* or 10*a* and the center-top tubular portion 2*b* or 10*b*. In this way, the strength of the expanded housing 2 or 10 having the function of the conventional so-called mounting cup is increased.

Due to the reinforcing action of the vertical plate rib-shaped portions 2*h* or 10*h*, the thickness of the other portions (the outer tubular portion 2*a* or 10*a*, the center-top tubular portion 2*b* or 10*b*, the annular ceiling portion 2*c* or 10*c*, and the like) of the expanded housing 2 or 10 is decreased as much as possible, and a total resin amount required for integral molding of the expanded housing is reduced.

Moreover, as in (34) and (35), the thickness of the portion of the center-top tubular portion 2*b* or 10*b*, in which the vertical groove-shaped portions 2*f* or 10*f* are not present, is decreased and the length in the so-called radial direction of the vertical plate rib-shaped portion 2*h* or 10*h* is decreased. In this way, a total resin amount required for integral molding of the expanded housing is reduced.

Moreover, as in (36), when the plastic intermediate cover body 7 on the upper surface of the stem gasket 5 is held by the upper-outer-side step 2*m* or 10*m* of the expanded housing 2 or 10 and a plastic coil spring is used as the coil spring 4, it is possible to eliminate the use of metal in the entire portion with which the emission target content (raw liquid) stored in the inner container 1*d* and the inner bag-shaped container 1*g* may make contact.

Here, when the intermediate cover body 7 is eliminated, the content may enter and penetrate into the stem gasket 5 due to a seal leakage in the contacting portion between the stem gasket 5 and the lower-inner-side step 2*k* or 10*k* of the expanded housing 2 or 10, the permeability of the content itself, and the pressure of the ejection gas. As a result, the emission target content in the container makes contact with the metal cover cap 8, the cover cap may deteriorate and deform and the content itself may degenerate.

The portions inside the container, making contact with the emission target content includes the inner container 1*d*, the inner bag-shaped container 1*g*, the expanded housing 2 or 10, the stem 3, the coil spring 4, the stem gasket 5, the housing gasket 6, the intermediate cover body 7, and the pipe 9. The pipe 9 is eliminated in a type which uses the inner bag-shaped container 1*g* illustrated in FIGS. 2 and 5.

Moreover, as in (37), the circumference of the side surface (the outer peripheral surface) of the outer tubular portion 2*a* or 10*a* is covered by a three-layer structure of the upper-end inner annular portion 1*e* or 1*h*, the upper-end annular portion 1*b*, and the annular skirt portion 8*b*. In this way, the vertical plate rib-shaped portions 2*h* or 10*h* are reinforced and the deformation or damage of the expanded housing 2 or 10 against an impact (the vertically downward pressing force applied when the lower end side of the annular skirt portion 8*b* of the cover cap is crimped to fix the housing mechanism to the aerosol container or the force applied in an inward direction due to crimping) on the annular skirt portion is prevented.

Moreover, as in (38), in the case of the dual-structure aerosol container including the inner bag-shaped container 1*g*, the vertical slit-shaped portions 10*p* for inside/outside communication are formed in the center-top tubular portion 10*b*, and the actual inside/outside communication area of the vertical slit-shaped portion is adjusted.

In this way, it is possible to secure the passage to the inside of the housing (the inside of the center-top tubular portion 10*b*), of the residual content in the upper space region of the inner bag-shaped container when the inner bag-shaped container in which the amount of content decreases due to a number of content releasing operations shrinks, a portion of the inner bag-shaped container is entangled with the center-bottom tubular portion 10*d*, and the action of allowing the content to flow into the vertical hole portion 10*j* is inhibited.

Moreover, by the adjustment of the actual inside/outside communication area of the vertical slit-shaped portion 10*p*, the balance between the amount of content flowing into the vertical hole portion 10*j* appropriately and the amount of content flowing from the vertical slit-shaped portion is optimized.

Figure 2:
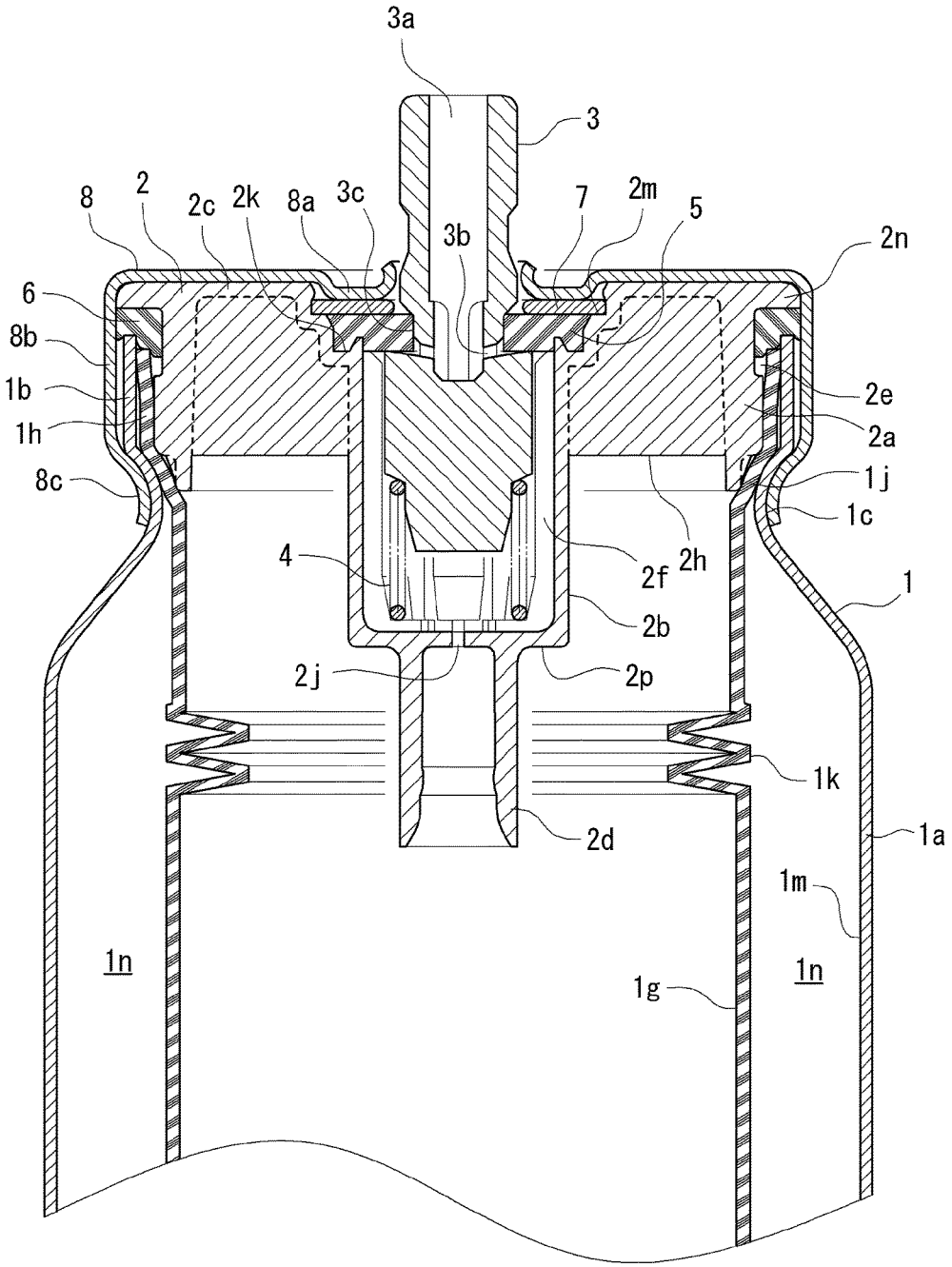
FIG. 2 is an explanatory diagram illustrating a dual-structure aerosol-type product to which a housing mechanism formed of an expanded housing 2 is attached.

FIGS. 1, 2, and 5 illustrate a stationary mode in which a user has not performed a content emission operation on the conventional operation button (not illustrated) (that is, the stem 3 is moved upward by the elastic force of the coil spring 4).

In this case, the stem gasket 5 is in an approximately horizontal state and blocks the space between the inner space regions of the inner container 1*d*, the inner bag-shaped container 1*g*, and the center-top tubular portion 2*b* or 10*b* and the stem hole portion 3*b* and the inner passage region 3*a* of the stem 3.

That is, the upper portion of the inner peripheral surface of the stem gasket 5 is in close contact with the upper bottom surface portion of the inner annular concave portion 3*c* of the stem 3 and the inner-side portion of the lower surface of the stem gasket 5 is in close contact with the lower-side end of the inner annular concave portion.

Thus, the content stored in the container (the inner container 1*d*, the inner bag-shaped container 1*g*, the center-top tubular portion 2*b* or 10*b*, and the like) will not flow into the inner passage region 3*a* of the stem 3.

When the user performs an operation of setting an operation mode to emit content using the operation button, the stem 3 moves downward while resisting the upward biasing force of the coil spring 4. At the same time, the inner-side portion (the portion close to the side being in contact with the stem 3) of the stem gasket 5 deforms like a so-called "bow".

With the downward movement of the stem 3 and the deformation of the stem gasket 5, the close-contact state between the inner-side portion of the lower surface of the stem gasket and the lower-side end of the inner annular concave portion 3*c* is released.

When the close-contact state is released, the inner space regions of the center-top tubular portion 2*b* or 10*b*, the inner container 1*d*, the inner bag-shaped container 1*g* of the expanded housing 2 or 10 communicate with the inner passage region 3*a* of the stem 3.

As a result, the content stored in the inner container 1*d* and the inner bag-shaped container 1*g* is discharged to the outside of the container from a conventional output hole portion (not illustrated) by the action of the ejection gas through "the pipe 9, the vertical hole portion 2*j* or 10*j*, the center-top tubular portion 2*b* or 10*b*, the stem hole portion 3*b*, and the inner passage region 3*a*".

The aerosol-type product illustrated in FIG. 1 is manufactured in the following order.

(41) The inner container 1*d* is incorporated into the outer container 1*a* in such a form as to maintain the initial height shape thereof, and emission target content (raw liquid) is filled into the inner container from an upper-end portion of the opening thereof.

(42) Subsequently, an aerosol valve (the expanded housing 2, the stem 3, the spring 4, the stem gasket 5, the housing gasket 6, the intermediate cover body 7, the cover cap 8, and the pipe 9) is fitted from above to both inner and outer sides of the upper-end circumferential portion of the outer container 1*a* and the inner container 1*d* so that the outer peripheral surface of the expanded housing 2 engages with the upper-end-side inner peripheral surface of the inner bag-shaped container.

(43) Subsequently, the lower-end side of the annular skirt portion 8*b* of the cover cap 8 is crimped toward the inner side so as to be attached to the outer container 1*a* using a conventional crimper.

(44) Subsequently, an ejection gas is filled from the stem 3 using a conventional gas filling apparatus.

When the user releases an operation of setting an operation mode on the operation button, the stem 3 which were at a downward moving position moves upward by the elastic biasing force of the coil spring 4, and the aerosol-type product returns to the stationary mode state illustrated in FIGS. 1, 2, and 5.

FIGS. 6 to 12 illustrate an aerosol housing mechanism with a housing cover.

New reference numerals used in these drawings are A, B, and 25 to 29. The other reference numerals appropriately use the same numbers as those of FIGS. 1 to 5.

In FIGS. 6 to 12,

A is an outer passage region (upstream-side passage region) formed of "a vertical concave portion 2*g* (described later), a separation portion between a downward step 2*p* (described later) and each of upward steps 25*d* to 29*d*, and a separation portion between an outer peripheral surface of a center-bottom tubular portion 2*d* (described later) and an inner peripheral surface of each of bottomed tubular portions 25*a* to 29*a* (described later)", extending from an upper-end-side portion of the inner space region of the inner bag-shaped container 1*g* to an inlet opening portion of the center-bottom tubular portion 2*d*, and B is an inner passage region (downstream-side passage region) extending from the inlet opening portion to the inner passage region 3*a* through "an inner space of the center-bottom tubular portion 2*d* (described later), a vertical hole portion 2*j* (described later), an inner space of the center-top tubular portion 2*b* (described later), and a stem hole portion 3*b* (described later)".

Moreover,

25 to 29 is a sheathed housing cover (25 in FIG. 6, 26 in FIG. 7, 27 in FIGS. 8 and 9, 28 in FIGS. 10 and 11, and 29 in FIG. 12) which is fitted to the outer peripheral surface of the center-top tubular portion 2*b* of the expanded housing 2 to set the outer passage region A extending from the upper-end-side inner space region of the inner bag-shaped container 1*g* to the inlet opening portion of the center-bottom tubular portion 2*d*,

25*a* to 29*a* is a small-diameter bottomed tubular portion formed of the lower-side portion of the housing cover and set on the outer side of the center-bottom tubular portion 2*d* in a separated form,

25*b* to 29*b* is a swelling portion formed at the center of the bottom surface of each of the bottomed tubular portions 25*a* to 29*a*,

25*c* to 29*c* is a large-diameter cover-top tubular portion formed of the upper-side portion of the housing cover and set in such a form as to be fitted to the outer peripheral surface of the center-top tubular portion 2*b*,

25*d* to 29*d* is an annular upward step continuously formed between the inner-side upper-end portion of each of the bottomed tubular portions 25*a* to 29*a* and the inner-side lower-end portion of each of the cover-top tubular portions 25*c* to 29*c*,

25*e* is a large-width annular flange-shaped portion (see FIG. 6) continuously formed from the upper-end portion of the cover-top tubular portion 25*c* toward the outer side of a horizontal plane to make contact with the lower end surface of the vertical plate rib-shaped portion 2*h* of the expanded housing 2,

26*f* is a small-width annular flange-shaped portion (see FIG. 7) continuously formed from the upper end portion of the cover-top tubular portion 26*c* toward the outer side of a horizontal plane to make contact with the lower end surface of the vertical plate rib-shaped portion 2*h* of the expanded housing 2,

27*g* is six radial stair-shaped pieces in total (circumferential upper-end-side pieces: see FIGS. 8 and 9) formed at intervals in the circumferential direction in a stair form climbing from the upper end portion of the cover-top tubular portion 27*c* toward the outer side of a horizontal plane (in the radial direction) and arranged between the adjacent vertical plate rib-shaped portions 2*h* of the expanded housing 2,

27*h* is six lower-surface annular portions in total formed of the lower-inner-side portion of the radial stair-shaped piece 27*g*,

27*j* is six upper-surface annular portions in total formed of the upper-outer-side portion of the radial stair-shaped piece 27*g*,

28*k* or 29*k* is six cone-shaped pieces in total (circumferential upper-end-side pieces: see FIGS. 10 to 12) formed at intervals in the circumferential direction in such a cone shape as to spread upward from the upper-end portion of the cover-top tubular portion 28*c* or 29*c* and arranged between the adjacent vertical plate rib-shaped portions 2*h* of the expanded housing 2,

27*m*, 28*m*, or 29*m* is six vertical notch-shaped portions in total which are set in such a form that extends continuously in a vertical direction of the cover-top tubular portion 27*c*, 28*c*, or 29*c* from the gap between the adjacent radial stair-shaped pieces 27*g* and the adjacent cone-shaped pieces 28*k* or 29*k* and which act as an entrance space region to the vertical plate rib-shaped portion 2*h* when the housing cover 27, 28, or 29 is attached to the expanded housing 2,

27*n*, 28*n*, or 29*n* is a bottom surface of the vertical notch-shaped portion, making contact with the lower end surface of the vertical plate rib-shaped portion 2*h* in a state in which the housing cover 27, 28, or 29 is attached to the expanded housing 2, and

29*p* is a tapered guiding portion (see FIG. 12) formed in such a form of being chamfered approximately at 45 degrees as to expand the circumferential inlet side of the vertical notch-shaped portion 28*m* of the housing cover 28 so as to guide the vertical plate rib-shaped portion 2*h* to facilitate the entrance into the lower-side portion of the vertical notch-shaped portion.

Here, the housing covers 25 to 29 are formed of plastics such as polypropylene, polyethylene, polyacetal, nylon, or polybutylene terephthalate.

Here, the characteristic component of the aerosol housing mechanism with the housing cover, illustrated in FIGS. 6 to 12 is the housing covers 25 to 29, and the other components are the same as those of FIGS. 2 to 4.

A contents discharge passage extending from the upper-end-side inner space region of the inner bag-shaped container 1*g* to the inner passage region 3*a* includes the outer passage region A extending downward between the expanded housing 2 and each of the housing covers 25 to 29 and the inner passage region B extending upward inside the housing on the downstream side of the outer passage region A.

The respective components including the expanded housing 2, the housing covers 25 to 29, the valve mechanisms (3, 4, and 5), the housing gasket 6, the intermediate cover body 7, and the cover cap 8 are incorporated into the outer container 1*a* and the inner bag-shaped container 1*g* in a valve unit VU form (aerosol valve) in which the entireties are integrated.

The annular skirt portion 8*b* of the cover cap 8 in the valve unit VU before the incorporation is not crimped.

The aerosol-type product illustrated in FIGS. 2, 5 to 8, and 10 is assembled and manufactured in the following order.

(41) The inner bag-shaped container 1*g* is incorporated into the outer container 1*a* in such a form as to maintain the initial height shape thereof, and emission target content (raw liquid) is filled into the inner bag-shaped container from an upper-end portion of the opening thereof.

(42) Subsequently, the valve unit VU is fitted from above to both inner and outer sides of the upper-end circumferential portion of the outer container 1*a* and the inner bag-shaped container 1*g* so that the outer peripheral surface of the expanded housing 2 engages with the upper-end-side inner peripheral surface of the inner bag-shaped container and the entire valve unit is separated slightly upward from the outer container 1*a*.

(43) Subsequently, ejection gas is filled into the lower-side portion of the housing gasket 6 in a non-sealed state and the gap portion of the outer container 1*a* and the inner bag-shaped container 1*g* from the gap portion between the upper-end-side outer peripheral surface of the outer container 1*a* and the inner peripheral surface of the annular skirt portion of the cover cap 8 using a conventional gas filling apparatus.

(44) The valve unit VU is pressed and the lower-end side of the annular skirt portion 8*b* of the cover cap 8 is crimped toward the inner side similarly using a conventional gas filling apparatus.

The inner bag-shaped container 1*g* incorporated into the outer container 1*a* in step (41) does not contract in the vertical direction with the bellows-shaped portion 1*k* maintaining its initial length but is held in a standing state in which the lower-end portion thereof is in contact with the bottom surface of the outer container 1*a*. In this case, the upper-end portion of the inner bag-shaped container 1*g* is positioned above the upper-end portion of the outer container 1*a* and is in a state of protruding slightly from the outer container 1*a*.

Moreover, when the valve unit VU is pressed in step (44), the bellows-shaped portion 1*k* of the inner bag-shaped container 1*g* shrinks in the vertical direction from the initial state of (41) and the upper-end portion of the inner bag-shaped container enters into the outer container 1*a* (see FIGS. 2, 5 to 8, and 10).

In this manner, when emission target content (raw liquid) is stored in the inner bag-shaped container 1*g*, ejection gas is filled in the pressure application space region 23, and the lower-end side of the annular skirt portion 8*b* is crimped while pressing the integrated structure of the valve unit VU and the inner bag-shaped container 1*g* downward, a final aerosol-type product is manufactured.

The followings are new features of the aerosol housing mechanism having the housing cover, illustrated in FIGS. 6 to 12.

(51) The expanded housing 2 having the conventional structure, which includes the inner passage region B in which emission target content flows therein from the lower opening side of the center-bottom tubular portion 2*d* and moves upward toward the inner passage region 3*a* and in which a conventional dip tube (not illustrated) for entrance of content can be attached to the center-bottom tubular portion is used as it is.

(52) The expanded housing 2 having the conventional structure is surrounded from below by the tapered housing covers 25 to 29 to form the outer passage region A between the outer peripheral surface of the housing and the inner peripheral surface of the housing cover so as to continuously extend downward from the upper-end-side inner space region of the inner bag-shaped container 1*g* to the inner passage region B.

That is, since the upper-end-side inner space region of the inner bag-shaped container 1*g* is set as an entrance portion of the outer passage region A, when an initial emission operation is performed once or several times before shipping aerosol-type products, residual air in the upper-end-side inner space region is discharged to the outside of the container.

Here, naturally, the residual air in the upper-end-side inner space region of the inner bag-shaped container 1*g* is discharged to the outside of the container even when any one of the housing covers 25 to 29 is used.

In the case of the aerosol-type product having such a dual-structure aerosol container as illustrated in FIGS. 2, 5 to 8, and 11, an amount of air corresponding to the inner space region of the valve unit remains inevitably in the upper-end-side inner space region of the inner bag-shaped container after an operation of attaching the valve unit VU to the inner bag-shaped container 1*g* in (42) ends.

This layer of residual air is discharged to the outside of the container in a compressed state together with content (raw liquid) by the emission operation, which becomes the cause of the scattering of ejection content.

The aerosol housing mechanism having the housing cover, illustrated in FIGS. 6 to 12 has a function of allowing unnecessary residual air which is inevitably present in the upper-end-side inner space region of the inner bag-shaped container 1*g* to reliably enter into the outer passage region A by an initial emission operation after a product is manufactured to discharge the residual air to the outside of the container.

FIGS. 6 to 8 and 10 illustrate so-called operation modes when the stationary mode operation button (not illustrated) is pressed, for example.

In these operation modes, the emission target content (raw liquid) in the inner bag-shaped container 1*g* biased so as to contract by the action of the ejection gas in the pressure application space region 23 is discharged to the outside of the container through "the outer passage region A, the inner passage region B (the vertical hole portion 2*j* and the inside of the center-top tubular portion 2*b*), the stem hole portion 3*b*, the inner passage region 3*a*, and an operation button passage portion (not illustrated)".

The difference from the operation mode illustrated in FIG. 2 is that the content in the inner bag-shaped container 1*g* first passes through the outer passage region A.

The difference in the discharge mechanism of the dual-structure aerosol container illustrated in FIGS. 6 to 8 and 10 is the shape of the housing covers 25, 26, 27, and 28.

That is, in a state in which the housing cover is fitted to the outer peripheral surface of the center-top tubular portion 2*b* of the expanded housing 2, the housing is set in the following manner.

Figure 6:
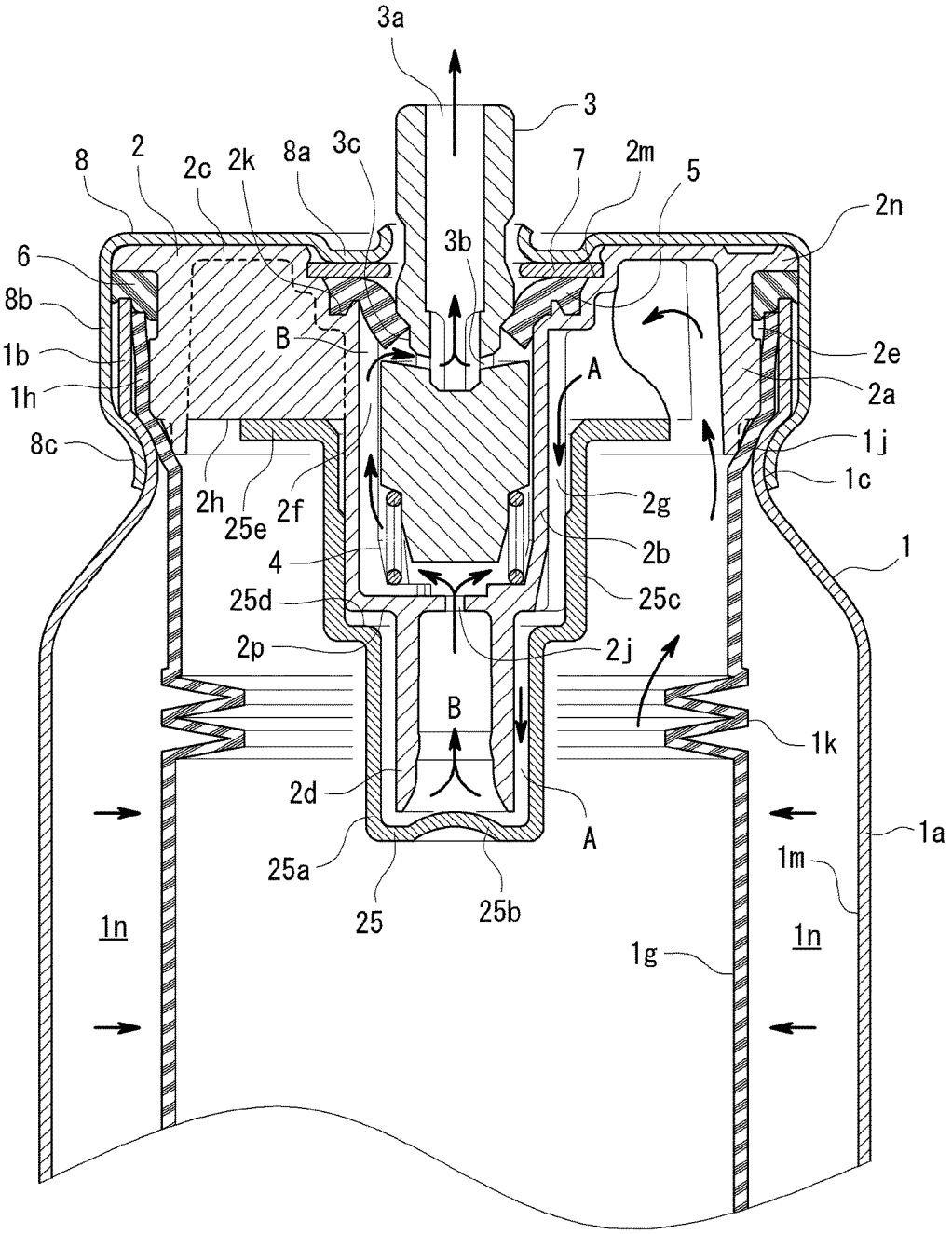
FIG. 6 is an explanatory diagram illustrating a dual-structure aerosol-type product to which a housing mechanism having such a form that a housing cover 25 formed of large-width annular flange-shaped portions 25*e* are fitted to a lower portion of an outer surface of the expanded housing 2 to which a general dip tube can be attached is attached.

(61) The large-width annular flange-shaped portions 25*e* of the housing cover 25 illustrated in FIG. 6 make contact with the lower end surfaces of the six vertical plate rib-shaped portions 2*h* of the expanded housing 2.

Figure 7:
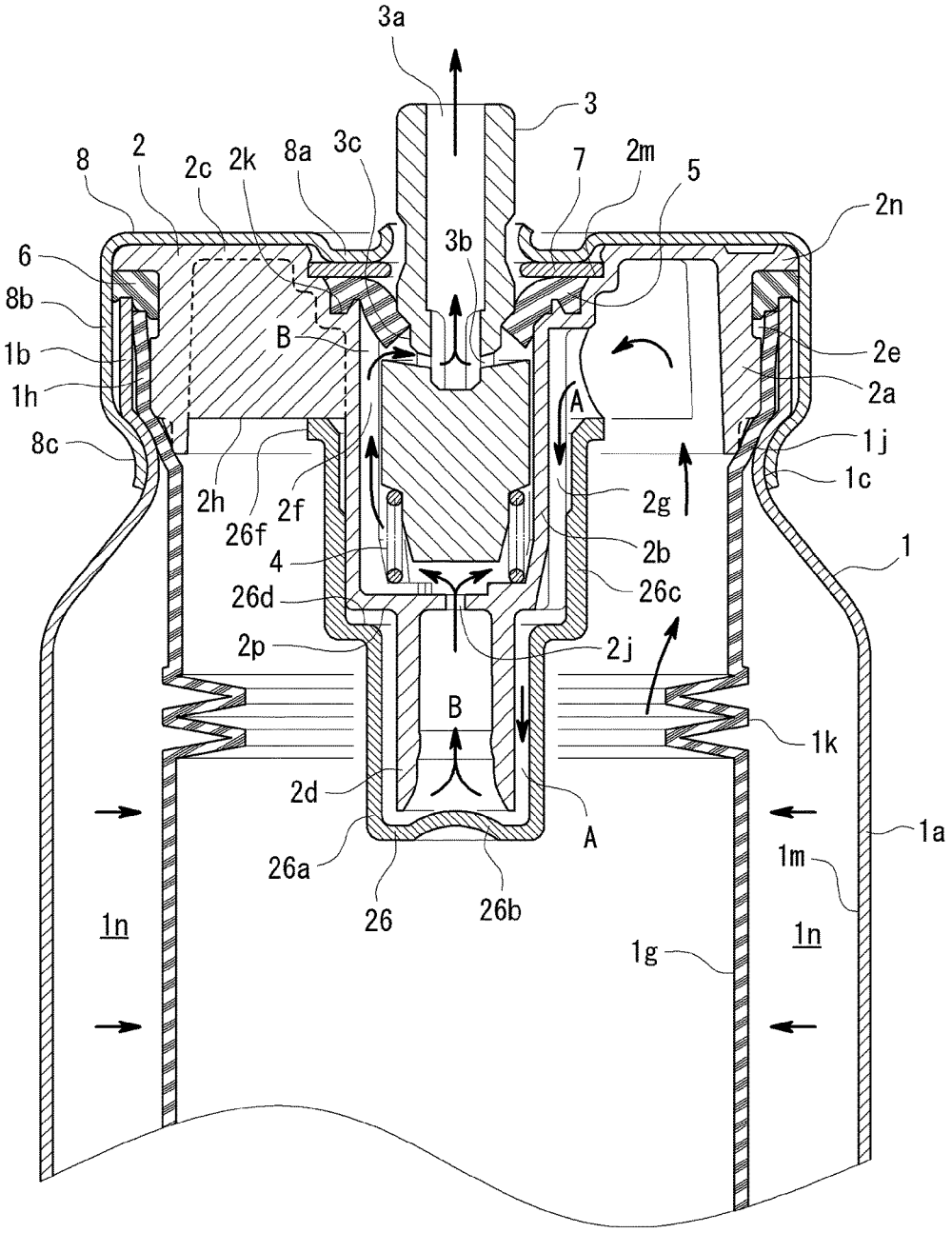
FIG. 7 is an explanatory diagram illustrating a dual-structure aerosol-type product to which a housing mechanism having such a form that a housing cover 26 formed of small-width annular flange-shaped portions 26*f* are fitted to a lower portion of an outer surface of the expanded housing 2 having the same shape as that of FIG. 6 is attached.

(62) The small-width annular flange-shaped portions 26*f* of the housing cover 26 illustrated in FIG. 7 make contact with the lower end surfaces of the six vertical plate rib-shaped portions 2*h* of the expanded housing 2.

Figure 8:
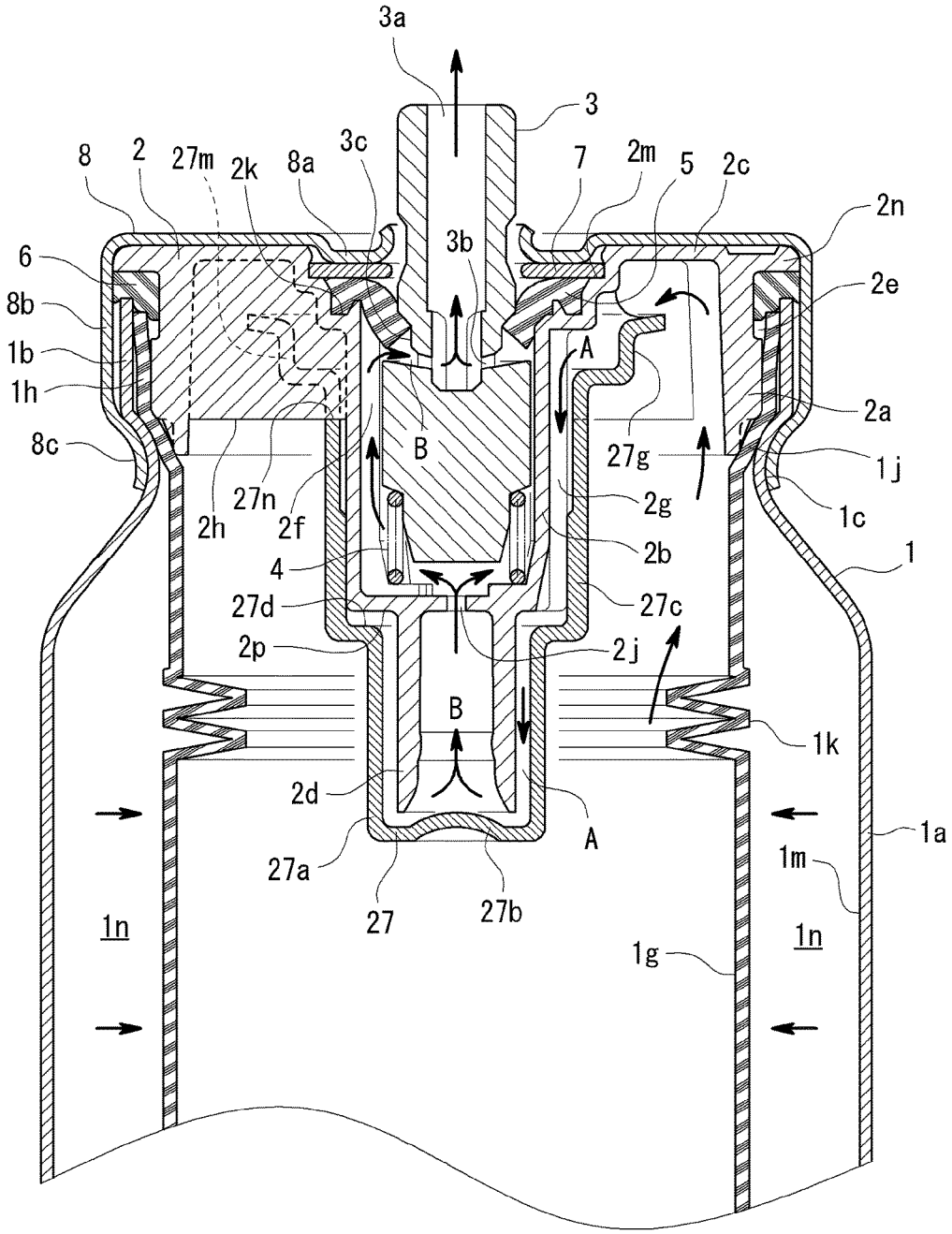
FIG. 8 is an explanatory diagram illustrating a dual-structure aerosol-type product to which a housing mechanism having such a form that a housing cover 27 formed of radial stair-shaped pieces 27*g* are fitted to a lower portion of an outer surface of the expanded housing 2 having the same shape as that of FIG. 6 is attached.
Figure 9:
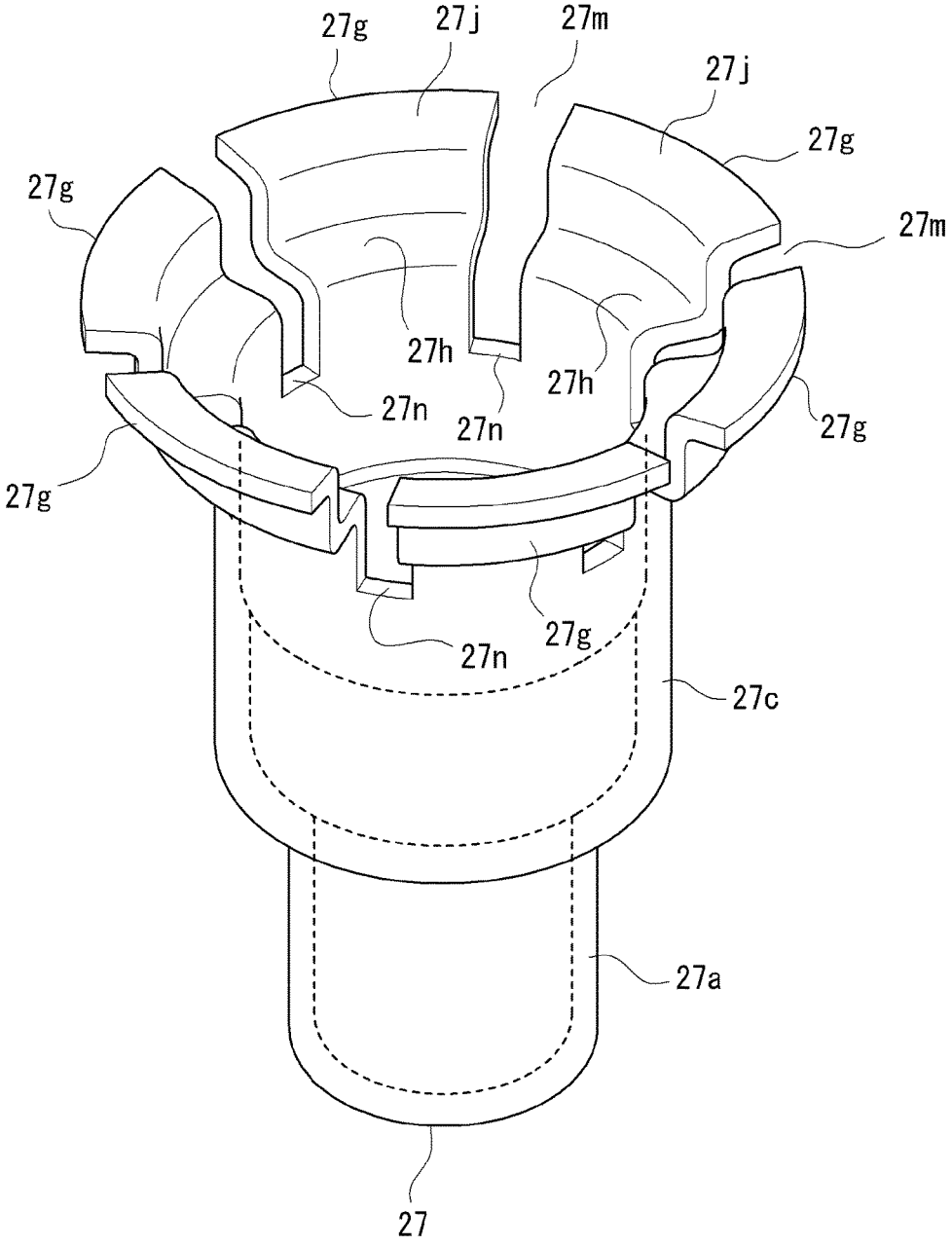
FIG. 9 is an explanatory diagram illustrating a perspective view state of the housing cover 27 illustrated in FIG. 8.

(63) The radial stair-shaped pieces 27*g* of the housing cover 27 illustrated in FIGS. 8 and 9 enter into the adjacent upper-end-side space regions (the upper-end-side inner space regions of the inner bag-shaped container 1*g*) of the vertical plate rib-shaped portions 2*h* of the expanded housing 2 and the bottom surfaces 27*n* of the vertical notch-shaped portions make contact with the lower end surfaces of the vertical plate rib-shaped portions 2*h*.

Figure 10:
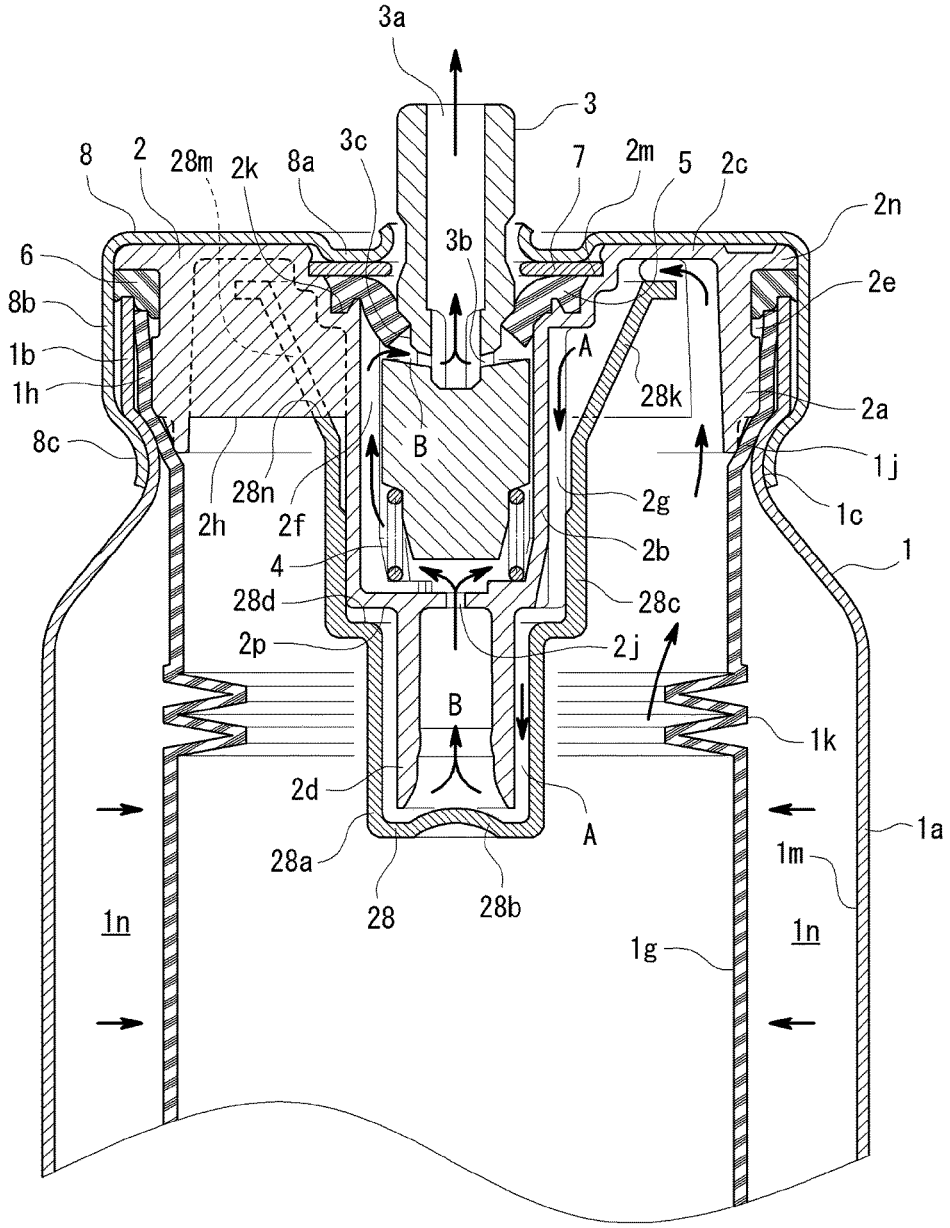
FIG. 10 illustrates a dual-structure aerosol-type product to which a housing mechanism having such a form that a housing cover 28 formed of cone-shaped pieces 28*k* are fitted to a lower portion of an outer surface of the expanded housing 2 having the same shape as that of FIG. 6 is attached.
Figure 11:
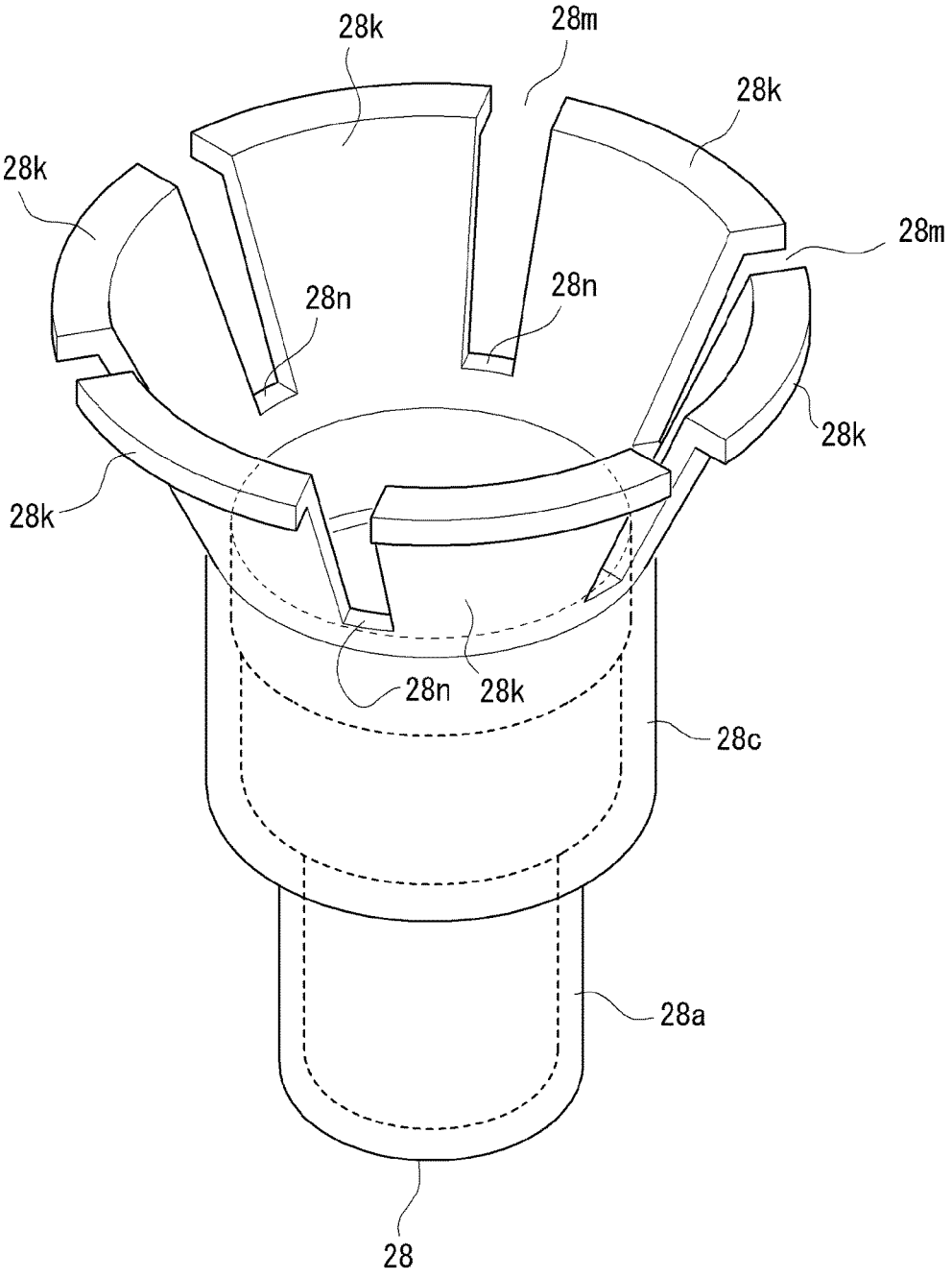
FIG. 11 is an explanatory diagram illustrating a perspective view state of the housing cover 28 illustrated in FIG. 10.

(64) The cone-shaped pieces 28*k* of the housing cover 28 illustrated in FIGS. 10 and 11 enter into the adjacent upper-end-side space regions (the upper-end-side inner space regions of the inner bag-shaped containers 1*g*) of the vertical plate rib-shaped portion 2*h* of the expanded housing 2 and the bottom surfaces 28*n* of the vertical notch-shaped portions make contact with the lower end surfaces of the vertical plate rib-shaped portions 2*h*.

Among these housing covers 25, 26, 27, and 28, the entrance portion (inlet portion) of the outer passage region A when the housing cover 27 or 28 was used is set in the upper-end-side inner space region formed of the inner bag-shaped container 1*g* and the expanded housing 2 and between the adjacent vertical plate rib-shaped portions 2*h*.

As described above, in the housing cover 27 or 28, the radial stair-shaped pieces 27*g* or the cone-shaped pieces 28*k* or 29*k* that form the entrance portion of the outer passage region A of the housing cover 27 or 28 are set between the adjacent vertical plate rib-shaped portions 2*h*.

Thus, a layer of air generated in the upper-end-side inner space regions between the adjacent vertical plate rib-shaped portions 2*h* when the valve unit VU was attached to the inner bag-shaped container 1*g* after ejection of the emission target content (raw liquid) flows into the outer passage region A more reliably.

That is, in the case of the housing cover 27 or 28, the air present between the vertical plate rib-shaped portions of the inner bag-shaped container 1*g* after attachment of the valve unit VU is more reliably discharged from the outer passage region A which uses the vertical plate rib-shaped portions as its inlet portion (entrance) to the outside of the container through the inner passage region B and the inner passage region 3*a*.

Figure 12:
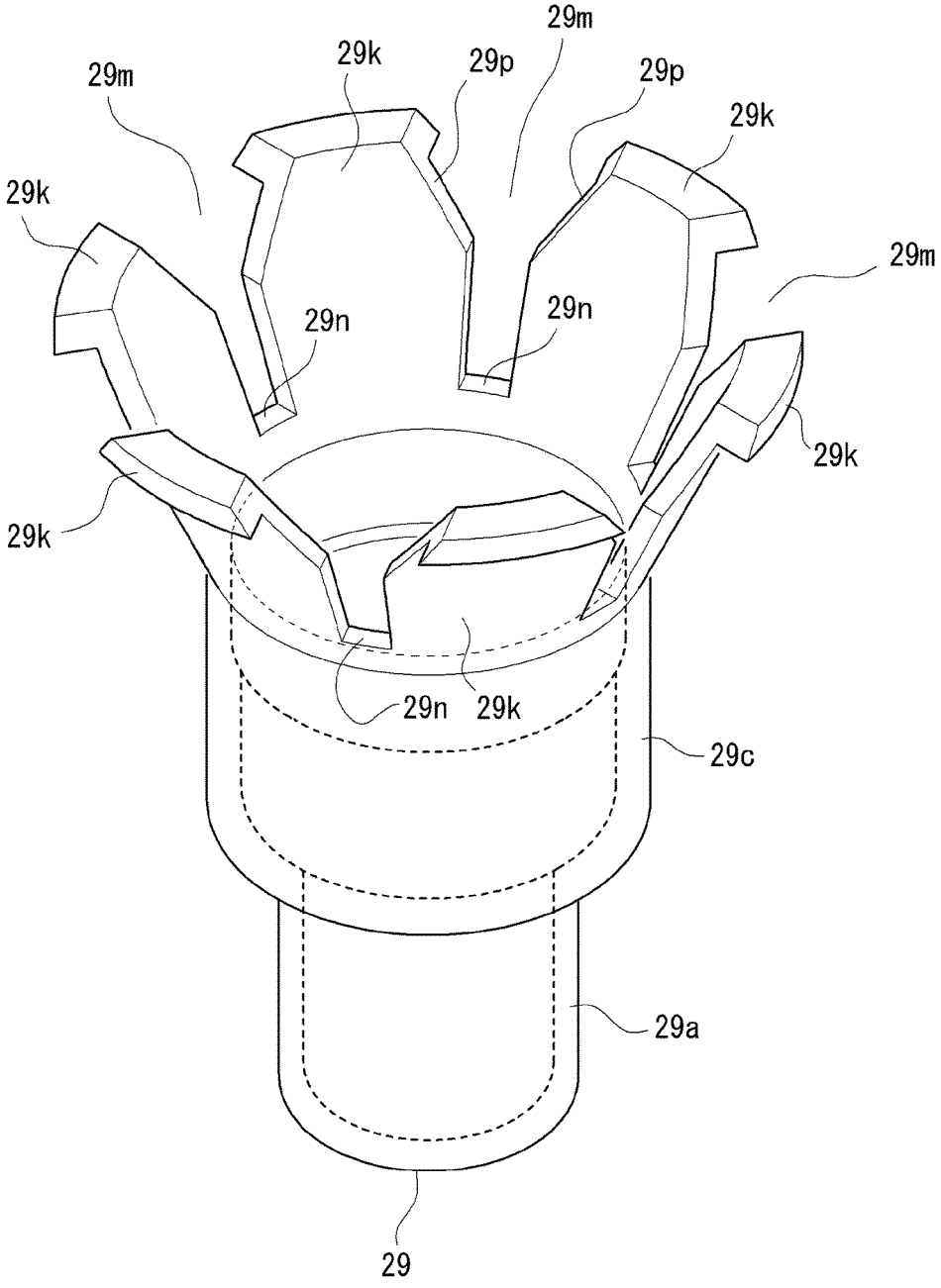
FIG. 12 is an explanatory diagram illustrating a perspective view state of a housing cover 29 which is a variation of the housing cover 28 illustrated in FIGS. 10 and 11.

The housing cover 29 illustrated in FIG. 12 includes the tapered guiding portion 29*p* which is provided on the entrance side of the vertical notch-shaped portion 28*m* of the housing cover 28 illustrated in FIG. 10, 11 so as to guide the vertical plate rib-shaped portion 2*h* to facilitate the entrance of the vertical plate rib-shaped portion 2*h*. Even when the vertical plate rib-shaped portion 2*h* is greatly shifted from the circumferential central portion of the vertical notch-shaped portion 29*m*, since the tapered guiding portion 29*p* guides the vertical plate rib-shaped portion 2*h* to the circumferential central portion to realize alignment, the housing cover 29 can be easily fitted to the expanded housing 2. Since a gap is formed between the vertical plate rib-shaped portion 2*h* and the tapered guiding portion 29*p* and the inlet portion (entrance) of the outer passage region A falls when the tapered guiding portion 29*p* is formed large, the height of the tapered guiding portion 29*p* is preferably set to approximately ½ to ⅓ of the entire depth of the vertical notch-shaped portion 29*m* including the tapered guiding portion.

The portions that makes contact with the emission target content stored in the inner bag-shaped container 1*g* include the inner bag-shaped container 1*g*, the expanded housing 2, the stem 3, the coil spring 4, the stem gasket 5, the housing gasket 6, and the intermediate cover body 7 as in FIG. 2 as well as the housing covers 25 to 29.

Naturally, the present invention is not limited to those illustrated in FIGS. 1 to 12 but may be modified in the following manner, for example.

(71) Various operation buttons such as a press-type button or a tilt-type button (a spout-type button) may be used as an operating unit for driving the stem 3.

(72) The number, thickness, shape, and the like of the vertical plate rib-shaped portions 2*h* or 10*h* may be set arbitrarily.

(73) The inner container 1*d* and the inner bag-shaped container 1*g* of the aerosol container 1 may be eliminated.

(74) The vertical slit-shaped portion 10*p* may be formed in a portion of the vertical groove-shaped portion 10*f* of the center-top tubular portion 10*b* and the convex outer peripheral surface on the rear side thereof, which does not overlap the inner-side end surface of the vertical plate rib-shaped portion 10*h*.

(75) The same tapered guiding portion as the tapered guiding portion 29*p* of the housing cover 29 may be formed in the upper-side portion of the vertical notch-shaped portion 27*m* of the housing cover 27.

The emission target content comes in various states such as a liquid state, a foaming (foamy) state, a creamy state, a paste state, a gel state, a powder state, for example.

Aerosol-type products to which the present invention is applied include products for various applications such as hair-care products such as hair dye, hair styling agents, hair treatment agents, and hair tonic, skin-care products such as sunscreen, lotion, cleansing, shaving foam, and pest repellents, cosmetics, cleaner, cleaning agents, coolant, muscle antiphlogistic agents, food, droplet products (such as vitamins), medical products, non-medical products, paint, gardening agents, insecticide, cleaners, deodorant, laundry starch, urethane foam, fire extinguisher, adhesives, and lubricants.

Examples of the emission target content stored in the container body include powder-like products, oil components, alcohols, surfactants, high molecular compounds, and components effective for individual applications.

The powder-like products that may be used include a metal salt powder, an inorganic powder, a resin powder, and the like. The usable powder products include talc, kaolin, aluminum hydroxychloride (aluminum salt), calcium alginate, gold powder, silver powder, mica, carbonate, magnesium chloride, silica, zinc oxide, titanium oxide, zeolite, nylon powder, barium sulfate, cellulose, and a mixture thereof, for example.

The oil components that may be used include silicone oil such as dimethylpolysiloxane, ester oil such as myristate isopropyl, oils and fats such as palm oil, eucalyptus oil, camellia oil, olive oil, and the jojoba oil, hydrocarbon oil such as liquid paraffin (paraffin oil), a fatty acid such as myristic acid, palmitic acid, stearic acid, linoleic acid, and linolenic acid, for example.

The alcohols that may be used include monohydric lower alcohols such as ethanol, monohydric higher alcohols such as lauryl alcohol and cetanol, and polyalcohols such as ethylene glycol, 1,3-butylene glycol, and glycerin, for example.

The surfactants that may be used include an anionic surfactant such as sodium lauryl sulfate, a nonionic detergent such as polyoxyethyleneoleyl ether and polyglycerin fatty acid ester, an amphoteric surfactant such as lauryl dimethyl aminoacetic acid betaine, and a cationic surfactant such as alkyl trimethyl ammonium chloride, for example.

The high molecular compounds that may be used include hydroxyethyl cellulose, methyl cellulose, gelatin, starch, and casein, for example.

The components effective for individual applications that may be used include an antiphlogistic balm such as methyl salicylate and indometacin, a sanitization agent such as sodium benzoate and cresol, a pest repellent such as pyrethroid and diethyltoluamide, an antiperspirant such as zinc para-phenolsulfonate, a tonic such as camphor, menthol, an antiasthmatic drug such as ephedrine and adrenalin, a sweetener such as sucralose or aspartame, adhesive and paint such as epoxy resin and urethane, dyes such as paraphenylenediamine and aminophenol, an oxidizer such as oxygenated water, a set agent such as acrylic resin and wax, ultraviolet absorbent such as 2-ethylhexyl p-methoxycinnamate, vitamins such as retinol and dl-α-tocopherol, humectants such as hyaluronic acid, fire extinguishing agents such as ammonium dihydrogen-phosphate, and sodium/potassium bicarbonate, for example.

Furthermore, besides the aforementioned contents, a suspending agent, an emulsifier, an antioxidant, and a sequestering agent, for example, can be used.

The ejection gas that may be used include compressed gas such as carbon dioxide, nitrogen gas, compressed air, oxygen gas, nitrous oxide, rare gas, and mixed gases thereof, liquefied gas such as liquefied petroleum gas, dimethyl ether, hydrofluoroolefin, and fluorocarbon, for example.

REFERENCE SIGNS LIST

1: Aerosol container
1*a*: Outer container
1*b*: Upper-end annular portion
1*c*: Annular concave portion
1*d*: Inner container (FIG. 1)
1*e*: Upper-end inner annular portion (FIG. 1)
1*f*: Inner annular concave portion (FIG. 1)
1*g*: Inner bag-shaped container (FIGS. 2, 5 to 8, and 10)
1*h*: Upper-end inner annular portion (FIGS. 2, 5 to 8, and 10)
1*j*: Inner annular concave portion (FIGS. 2, 5 to 8, and 10)
1*k*: Bellows-shaped portion (FIGS. 2, 5 to 8, and 10)
1*m*: Container inner surface
1*n*: Pressure application space region
2, 10: Expanded housing
2*a*, 10*a*: Outer tubular portion
2*b*, 10*b*: Center-top tubular portion
2*c*, 10*c*: Annular ceiling portion
2*d*, 10*d*: Center-bottom tubular portion
2*e*, 10*e*: Outer annular concave portion
2*f*, 10*f*: Vertical groove-shaped portion
2*g*, 10*g*: Vertical concave portion
2*h*, 10*h*: Vertical plate rib-shaped portion
2*j*, 10*j*: Vertical hole portion
2*k*, 10*k*: Lower-inner-side step
2*m*, 10*m*: Upper-outer-side step
2*n*, 10*n*: Annular flange-shaped portion
2*p*: Annular downward step
10*p*: Slit-shaped portion (FIG. 5)
11: Flow-rate adjustment member (FIG. 5)
11*a*: Annular step (FIG. 5)
3: Stem
3*a*: Inner passage region
3*b*: Stem hole portion
3*c*: Inner annular concave portion
4: Coil spring
5: Stem gasket
6: Housing gasket
7: Intermediate cover body
8: Cover cap
8*a*: Upper annular concave portion
8*b*: Annular skirt portion
8*c*: Crimped portion
9: Pipe (FIG. 1)
(Used in FIGS. 6 to 12 only)
A: Outer passage region (Upstream-side passage region)
B: Inner passage region (Downstream-side passage region)
25: Housing cover (FIG. 6)
26: Housing cover (FIG. 7)
27: Housing cover (FIGS. 8 and 9)
28: Housing cover (FIGS. 10 and 11)
29: Housing cover (FIG. 12)
25*a* to 29*a*: Small-diameter bottomed tubular portion
25*b* to 29*b*: Swelling portion
25*c* to 29*c*: Large-diameter cover-top tubular portion

25*d* to 29*d*: Annular upward step
25*e*: Large-width annular flange-shaped portion (FIG. 6)
26*f*: Small-width annular flange-shaped portion (FIG. 7)
27*g*: Radial stair-shaped piece (FIGS. 8 and 9)
27*h*: Lower-surface annular portion (FIG. 9)
27*j*: Upper-surface annular portion (FIG. 9)
28*k*, 29*k*: cone-shaped piece (FIGS. 10 to 12)
27*m*, 28*m*, 29*m*: Vertical notch-shaped portion (FIGS. 8 to 12)
27*n*, 28*n*, 29*n*: Bottom surface of vertical notch-shaped portion (FIGS. 8 to 12)
29*p*: Tapered guiding portion (FIG. 12)

The invention claimed is:

1. An aerosol housing mechanism comprising:
an outer tubular portion attached to an opening side of a container body that stores emission target content and ejection gas;
a central tubular portion formed on an inner side of the outer tubular portion so as to store at least a lower-slide portion of a stem that operates with a content emission operation in an interlocked manner;
wherein
a vertical groove-shaped portion for passage of content is formed in a portion of an inner peripheral surface of the central tubular portion, and
a vertical concave portion is formed in a portion of an outer peripheral surface of the central tubular portion, which is on a rear side of an inner peripheral surface portion in which the vertical groove-shaped portion is not formed;
an annular ceiling portion formed between an upper end portion of the outer tubular portion and an upper end portion of the central tubular portion; and
a rib-shaped portion formed between the outer tubular portion and the central tubular portion to enhance a structural strength, wherein
entireties of the outer tubular portion, the central tubular portion, the annular ceiling portion, and the rib-shaped portion are integrally molded using a plastic.

2. The aerosol housing mechanism according to claim 1, wherein
a plurality of the rib-shaped portions is formed in a radial form to extend from the central tubular portion to the outer tubular portion.

3. The aerosol housing mechanism according to claim 1, wherein
the rib-shaped portion is formed between the inner peripheral surface of the outer tubular portion and a rear-side outer peripheral surface portion of the vertical groove-shaped portion.

4. The aerosol housing mechanism according to claim 1, wherein
the annular ceiling portion includes:
an annular lower end port; formed on an inner end side so as to hold an outer peripheral edge portion of a stem gasket that performs a valve action between the stem and the stem gasket; and
an annular upper end portion formed on an upper side of the lower end portion so as to hold an outer peripheral edge portion of an annular plastic cover body provided in an upper surface portion of the stem gasket.

5. The aerosol housing mechanism according to claim 1, wherein
an outer peripheral surface of the outer tubular portion is protected by a three-layer member including:
a tubular skirt portion on an outer end side of an annular metal cover body that covers the annular ceiling portion;
an upper-end intermediate annular portion which is a portion of an outer container and is arranged on an inner side of the tubular skirt portion; and
an upper-end inner annular portion which is a portion of an inner container provided in an inner space region of the outer container and is arranged on an inner side of the upper-end intermediate annular portion.

6. The aerosol housing mechanism according to claim 1, wherein the central tubular portion includes a lower tubular portion to which a tube for entrance of content is attached.

7. The aerosol housing mechanism according to claim 1, further comprising:
a housing cover of an upper opening, provided in such a form as to surround a lower side of the central tubular portion to form an outer passage region between the housing cover and the outer peripheral surface of the central tubular portion, the outer passage region extending downward from an upper end side of an inner space region of the container body to an inner passage region inside the central tubular portion, wherein
the emission target content ejected to an outside of the container moves downward from the upper end side along the outer passage region and then flows upward along the inner passage region.

8. The aerosol housing mechanism according to claim 7, wherein the housing cover includes an upper-end-side piece which enters into an individual upper-end-side inner space region set between the adjacent rib-shaped portions and acts as an entrance portion of the outer passage region.

9. An aerosol-type product comprising the aerosol housing mechanism according to claim 1, in which the emission target content and the ejection gas are stored in the container body.

* * * * *